US009109559B2

(12) United States Patent
Kondo et al.

(10) Patent No.: US 9,109,559 B2
(45) Date of Patent: Aug. 18, 2015

(54) FUEL INJECTION APPARATUS

(71) Applicant: DENSO CORPORATION, Kariya, Aichi-pref. (JP)

(72) Inventors: Shingo Kondo, Kariya (JP); Tooru Taguchi, Handa (JP); Takashi Aoki, Toyoake (JP)

(73) Assignee: DENSO CORPORATION, Kariya (JP)

( * ) Notice: Subject to any disclaimer, the term of this patent is extended or adjusted under 35 U.S.C. 154(b) by 294 days.

(21) Appl. No.: 13/860,043

(22) Filed: Apr. 10, 2013

(65) Prior Publication Data

US 2013/0270370 A1 Oct. 17, 2013

(30) Foreign Application Priority Data

Apr. 11, 2012 (JP) ..... 2012-90075

(51) Int. Cl.

| | |
|---|---|
| ***B05B 1/30*** | (2006.01) |
| ***F02M 51/06*** | (2006.01) |
| ***F02M 47/02*** | (2006.01) |
| ***F02M 51/00*** | (2006.01) |
| ***F02M 61/16*** | (2006.01) |
| ***F02M 63/00*** | (2006.01) |

(52) U.S. Cl.

CPC ..... *F02M 51/0614* (2013.01); *F02M 47/027* (2013.01); *F02M 51/005* (2013.01); *F02M 61/168* (2013.01); *F02M 63/0019* (2013.01); *F02M 2200/16* (2013.01); *F02M 2200/8046* (2013.01)

(58) Field of Classification Search

CPC ..... F02M 51/0621; F02M 51/0653
USPC ..... 239/585.1, 585.5, 584
See application file for complete search history.

(56) References Cited

U.S. PATENT DOCUMENTS

| | | | | |
|---|---|---|---|---|
| 4,756,981 | A * | 7/1988 | Breault et al. | 429/469 |
| 6,834,844 | B1 * | 12/2004 | Hamada et al. | 251/129.1 |
| 2009/0184118 | A1 * | 7/2009 | Kobayashi et al. | 220/62.22 |

FOREIGN PATENT DOCUMENTS

| | | |
|---|---|---|
| JP | 5-132569 | 5/1993 |
| JP | 06-235359 | 8/1994 |
| JP | 2005-016355 | 1/2005 |
| JP | 2005-209853 | 8/2005 |
| JP | 2007-205263 | 8/2007 |
| JP | 4363369 | 8/2009 |
| JP | 2010-019308 | 1/2010 |

OTHER PUBLICATIONS

Office Action (2 pages) dated Oct. 21, 2014, issued in corresponding Japanese Application No. 2012-090075 and English translation (3 pages).

(Continued)

*Primary Examiner* — Davis Hwu
(74) *Attorney, Agent, or Firm* — Nixon & Vanderhye PC

(57) ABSTRACT

A resin-bonded body of a fuel injection apparatus includes a first resin material and a second resin material, which are bonded together and have different properties, respectively. The resin-bonded body has a fuel seal portion to limit leakage of fuel from a boundary surface between the first resin material and the second resin material to an outside. The fuel seal portion is formed in a portion of the boundary surface and is surface-modified to increase hydrophilicity of the fuel seal portion.

8 Claims, 13 Drawing Sheets

(56) References Cited

OTHER PUBLICATIONS

Office Action (1 page) dated Apr. 1, 2014, issued in corresponding Japanese Application No. 2012-090075 and English translation (2 pages).

Office Action (4 pages) dated Feb. 24, 2015, issued in corresponding Japanese Application No. 2012-090075 and English translation (6 pages).

* cited by examiner

FUEL INJECTION APPARATUS

CROSS REFERENCE TO RELATED APPLICATION

This application is based on and incorporates herein by reference Japanese Patent Application No. 2012-90075 filed on Apr. 11, 2012.

TECHNICAL FIELD

The present disclosure relates to a fuel injection apparatus.

BACKGROUND

A fuel injection apparatus is installed in a vehicle (e.g., an automobile). The fuel injection apparatus injects fuel into a cylinder of an internal combustion engine, such as a diesel engine.

In a previously known fuel injection apparatus, an injector is provided to directly inject high pressure fuel, which is supplied from a high pressure generating device (e.g., a fuel injection pump or a common rail), into the cylinder of the internal combustion engine.

One such an injector is a fuel injection valve that has a fuel injection nozzle and a solenoid valve, which are integrally assembled together. The fuel injection nozzle includes an injection hole and a needle. The needle axially reciprocates to open and close the injection hole. The solenoid valve controls opening and closing movement of the needle. This kind of injector is disclosed in, for instance, JP4363369B2 and JP2007-205263A.

FIGS. 12 and 13 illustrate a previous proposed injector of one such a type. As shown in FIGS. 12 and 13, the injector has a solenoid valve, which includes a valve 103, an armature 104, a spring 105 and a solenoid (also known as a solenoid actuator). The valve 103 opens and closes a valve hole 102 of a valve seat 101. The armature 104 is made of a magnetic metal material. The armature 104 drives the valve 103 toward the valve hole 102 in a valve-opening direction. The spring 105 urges the valve 103 in a valve-closing direction, which is opposite from the valve-opening direction. The solenoid includes a coil 106. When the coil 106 is energized, a magnetic attractive force, which magnetically attracts the armature 104 is generated from the solenoid.

The solenoid includes a coil device and a stator 109. The coil device includes the coil 106, a resin bobbin 107 and a resin mold 108. The stator 109 is made of a magnetic metal material and magnetically attracts the armature 104 upon the energization of the coil 106.

The armature 104 is slidably supported in a slide hole 112 of a valve body 111 made of a non-magnetic metal material. A housing 113, which is made of a non-magnetic metal material, is placed at an upper end portion of the stator 109. A connector 114, which is made of a synthetic resin material, is molded at an upper end portion of the housing 113.

The coil device of the solenoid further includes terminals 115, 116 besides the coil 106, the resin bobbin 107 and the resin mold 108.

Fuel drain passages 121-127 are formed in an inside of the injector, particularly in the solenoid valve to return fuel, which is leaked from the inside of the fuel injection nozzle, to a fuel tank.

In the injector, it is important to limit the leakage of the fuel, which is guided into the inside of the solenoid valve, to the outside. That is, it is important to limit the leakage of the fuel from the fuel drain passages 121-127 to the outside.

However, in the solenoid valve of the previously proposed injector, the resin bobbin 107 is molded from a thermoplastic resin material, and the resin mold 108 is molded from a thermoset resin material. Thus, the resin materials, which respectively have different coefficients of thermal expansion, are used to form the resin bobbin 107 and the resin mold 108, respectively.

Furthermore, in order to electrically insulate between the housing 113 and the terminals 115, dielectric bushes 118, 119 are received in a terminal receiving hole 117 of the housing 113.

The dielectric bushes 118, 119 are molded from a thermoplastic resin material. Therefore, a coefficient of thermal expansion of the dielectric bushes 118, 119 differs from the coefficient of thermal expansion of the housing 113 and the coefficient of thermal expansion of the terminals 115.

With the above construction, fuel leak passages 131, 132, which are located on the radially inner side of the resin bobbin 107, and a fuel leak passage 133, which is located on the radially outer side of the resin bobbin 107, are provided at a boundary surface between the resin bobbin 107 and the resin mold 108, a boundary surface between the resin bobbin 107 and the stator 109, a boundary surface between the resin mold 108 and the stator 109, a boundary surface between the resin mold 108 and the terminals 115 and a boundary surface between the dielectric bushes 118, 119 and the terminals 115.

In the previously proposed solenoid valve, in order to limit leakage of fuel from the fuel drain passage 122 to the outside through the fuel leak passages 131-133, two O-rings 141, 142 are placed in the terminal receiving hole 117.

In this way, the fuel leak from the inner passages to the outside can be limited.

However, in the solenoid valve installed in the previously proposed injector, the shape of the terminal receiving hole 117 and the outer shapes of the dielectric bushes 118, 119 become complicated due to the use of the two O-rings 141, 142. Furthermore, the size of the solenoid in the axial direction cannot be reduced. In addition, in the solenoid valve of the previously proposed injector, the two O-rings 141, 142 are required. Therefore, the number of the components and the number of the assembling steps are disadvantageously increased to cause an increase in the product costs.

SUMMARY

The present disclosure addresses the above disadvantages.

According to the present disclosure, there is provided a fuel injection apparatus that includes a resin-bonded body. The resin-bonded body includes a first resin material and a second resin material, which are bonded together and have different properties, respectively. The resin-bonded body has a fuel seal portion to limit leakage of fuel from a boundary surface between the first resin material and the second resin material to an outside. The fuel seal portion is formed in a portion of the boundary surface and is surface-modified to increase hydrophilicity of the fuel seal portion.

DETAILED DESCRIPTION (First Embodiment)

Figure 1:
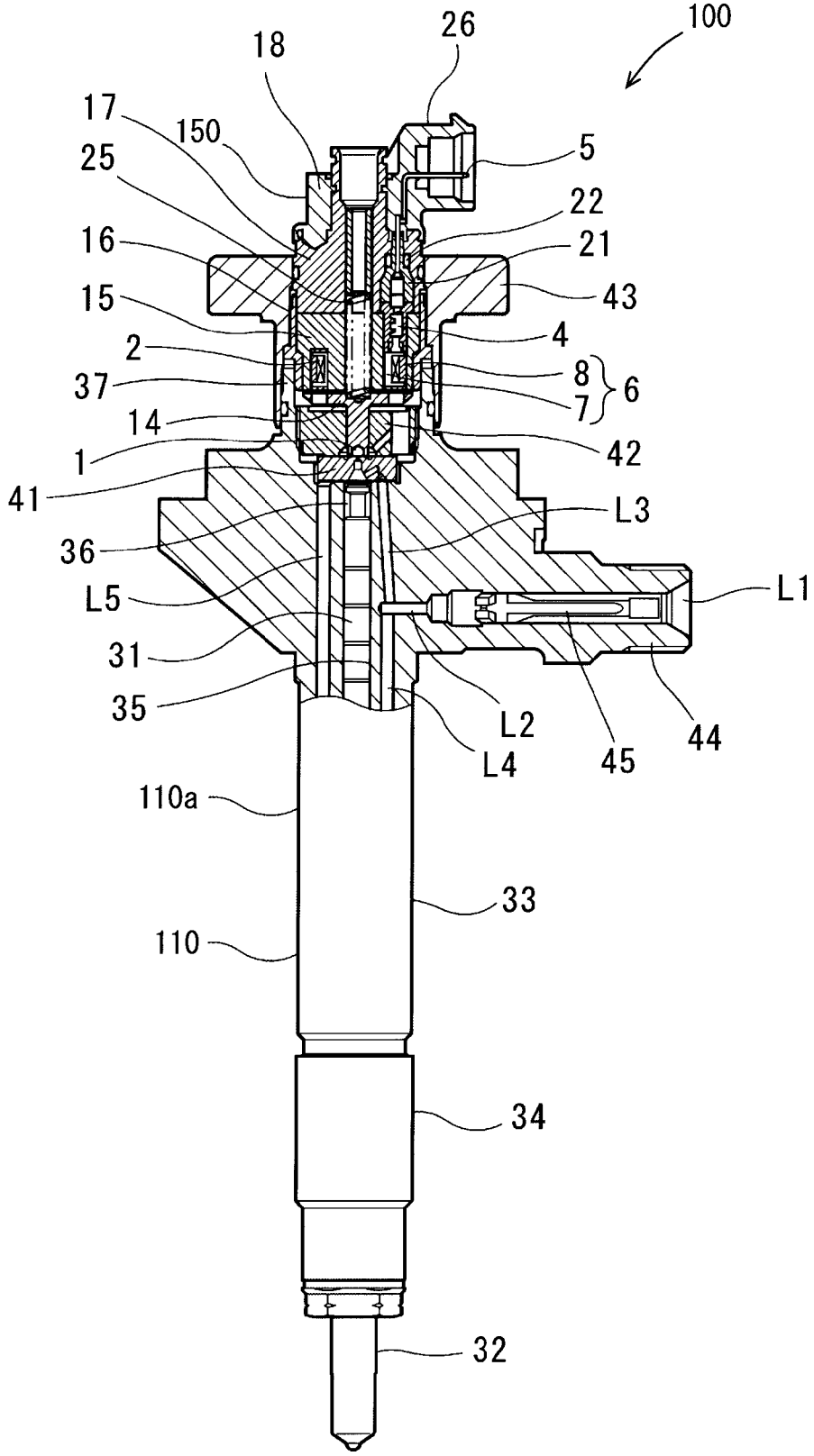
FIG. 1 is a partial cross-sectional view showing an entire structure of an injector according to a first embodiment of the present disclosure.

FIGS. 1 to 8B show a fuel seal structure of a solenoid valve of an injector of a fuel injection apparatus as well as a surface modification method of a thermoplastic resin bobbin of the solenoid valve according to a first embodiment of the present disclosure.

The fuel injection apparatus of the present embodiment is a common rail fuel injection apparatus or system (an accumulator type fuel injection apparatus).

The common rail fuel injection apparatus includes a supply pump, a common rail and a plurality of injectors 100. The supply pump pressurizes fuel to a high pressure. The common rail accumulates the high pressure fuel, which is supplied from the supply pump. The high pressure fuel is distributed from the common rail to the injectors 100. The high pressure fuel, which is accumulated in the common rail, is injected into a combustion chamber of a corresponding cylinder of the engine through the corresponding injector 100.

The supply pump or the common rail forms a high pressure source, which generates the high pressure fuel.

The injector 100 of the present embodiment is a fuel injection valve of the internal combustion engine of a direct injection type, which is installed to the corresponding one of the cylinders of the engine and directly injects the high pressure fuel received from the common rail into the combustion chamber in a form of mist. In this particular instance, the injector 100 is an injector of a diesel engine (an internal combustion engine).

The injector 100 is a solenoid fuel injection valve that includes a fuel injection nozzle 110 and a solenoid valve (also referred to as a solenoid control valve) 150, which are integrally assembled together. The fuel injection nozzle 110 includes a fuel injection hole and a needle. The fuel injection hole is configured to inject the fuel. The needle is configured to reciprocate to open and close the fuel injection hole.

The solenoid valve 150 includes a ball valve (a valve element of the solenoid valve 150, and hereinafter referred to as a valve) 1 and a solenoid actuator (also referred to as a solenoid) 151. The valve 1 is configured to reciprocate in the axial direction to open and close an outlet-side orifice 47 (a passage hole), through which the fuel flows. The solenoid actuator 151 includes a solenoid coil (hereinafter referred to as a coil) 2. The coil 2 generates a magnetic force when the coil 2 is energized. The solenoid actuator 151 drives the valve 1 with the magnetic force generated from the coil 2.

The energization of the solenoid valve 150 (more specifically, the coil 2) is controlled by an engine control unit (an electronic control unit that is abbreviated as ECU).

The ECU has a microcomputer of a known structure that includes an injector drive circuit (an electronic drive unit that is abbreviated as an EDU), a CPU, a ROM and a RAM.

When an ignition switch (or an ignition key) of the vehicle is turned on (IG ON), the microcomputer computes a fuel injection pressure to be supplied to the combustion chamber of each cylinder of the engine, the fuel injection timing of each injector 100 and the fuel injection quantity of each injector 100 upon execution of a control program stored in the memory, such as the ROM or the RAM. Also, the microcomputer electronically controls an injector drive signal (an injector drive current) supplied to the coil 2 of the solenoid valve 150 of each of the injectors 100.

The solenoid actuator 151 includes two terminals 4, two terminals 5 and a resin-bonded body 6. The terminals 4, 5 are arranged to extend from two coil end leads 3, respectively, of the coil 2 to the outside (the connector side). The resin-bonded body 6 is formed by bonding a surface of a first synthetic resin material (also referred to as a first resin material) and a surface of a second synthetic resin material (also referred to as a second resin material) with each other. The first synthetic resin material is a thermoplastic resin material, such as polyphenylene sulfide (PPS) or syndiotactic polystyrene (SPS). The second synthetic resin material is a thermoset resin material, such as epoxy (EP).

The resin-bonded body 6 includes a resin bobbin 7 and a resin mold 8. In this embodiment, the resin bobbin 7 is made of the thermoplastic resin material (more specifically the PPS), and the resin mold 8 is made of the thermoset resin (more specifically the EP).

The resin bobbin 7 has a circular hollow portion (circular space) 10, annular flanges 11, 12 and a cylindrical winding core portion 13. A conductive wire, which is coated with a dielectric film, is wound multiples times around the winding core portion 13 located between the flanges 11, 12.

Besides the above-described components, the solenoid actuator 151 further includes a movable core (hereinafter referred to as an armature) 14, a stationary core (hereinafter referred to as a stator core) 15, a non-magnetic metal case 16, a non-magnetic metal block 17 and a thermoplastic (PPS) resin-molded body (hereinafter referred to a resin-molded body) 18. The armature 14 is made of a magnetic material. The armature 14 is driven by the magnetic force, which is generated from the coil 2, to drive the valve 1 in a valve-opening direction. The stator core 15 is made of a magnetic material and forms a magnetic path on a radially inner side and a radially outer side of the coil 2. The non-magnetic metal case 16 is made of a non-magnetic metal material and surrounds an outer peripheral portion of the stator core 15. The non-magnetic metal block 17 is made of a non-magnetic metal material and is securely fitted to an inner peripheral portion of the non-magnetic metal case 16. The resin-molded body 18 forms the external connector, which connects between the coil 2 and an external circuit (an external power source and/or an external control circuit (ECU)).

The non-magnetic metal block 17 has two receiving holes 19, which extend through the non-magnetic metal block 17 between two opposed end surfaces of the non-magnetic metal block 17. Each receiving hole 19 receives a corresponding one of the terminals 5, a corresponding one of dielectric bushes 21 and a corresponding one of O-rings 22.

Furthermore, besides the 0-rings 22, the solenoid valve 150 further includes O-rings 23, 24. These 0-rings 22, 23, 24 serve as seal members, which limit leakage of the fuel from the inside to the outside of the solenoid valve 150.

The coil 2 and a return spring (hereinafter referred to a coil spring) 25 are received in the stator core 15. The coil spring 25 urges the armature 14 in a valve-closing direction.

A connector case 26 is formed integrally with the resin-molded body 18.

Details of the solenoid actuator 151 will be described later.

The fuel injection nozzle 110 has a housing 110*a*. The housing 110*a* receives the needle (not shown), a command piston (hereinafter referred to as a piston) 31 and a coil spring. The needle extends linearly in the axial direction. The piston 31 extends linearly in the axial direction. The coil spring is spirally wound around the piston 31.

The housing 110*a* of the fuel injection nozzle 110 has a nozzle body 32, an injector body 33 and a retaining nut 34. The nozzle body 32 has the injection hole and a fuel guide passage (a fuel passage). The fuel is injected through the injection hole. The fuel guide passage is communicated with the injection hole. The injector body 33 has a fuel passage, which is communicated with the injection hole through the fuel passage of the nozzle body 32. The retaining nut 34 securely holds the nozzle body 32 to an axial distal end portion (a lower end portion in FIG. 1) of the injector body 33 through thread engagement.

The nozzle body 32 has a nozzle hole (an axial hole) that extends along a central axis of the nozzle body 32. The nozzle hole receives the needle, which is joined to the piston 31 to reciprocate integrally with the piston 31 in the axial direction.

The nozzle body 32 has a fuel well and a nozzle seat. The fuel well communicates between the fuel guide passage and the injection hole. The nozzle seat is formed between the fuel well and the injection hole. The needle is seatable against the nozzle seat and is liftable away from the nozzle seat. The fuel well serves as a first pressure chamber (also referred to as an oil well chamber or a first fuel chamber) such that a hydraulic pressure (also referred to as an oil pressure or a fuel pressure) of the fuel, which is guided from the injector body 33 into the fuel well, is exerted in a valve-opening direction of the needle (a direction away from the injection hole).

The injector body 33 has a cylinder hole (an axial hole) 35, which extends along a central axis of the injector body 33. The piston 31 is received in the cylinder hole 35 in a manner that enables reciprocation of the piston 31 in the axial direction. Furthermore, a coil spring is received in the cylinder hole 35 of the injector body 33 to apply an urging force to the needle and the piston 31 in the valve-closing direction. The coil spring is a return spring, which generates an urging force (an axial force in the valve-closing direction) to urge the needle against the nozzle seat of the nozzle body 32.

A pressure control chamber 36 is formed in an upper end portion of the cylinder hole 35 in FIG. 1. The pressure control chamber 36 serves as a second pressure chamber (also referred to as a back-pressure control chamber or a second fuel chamber) such that a hydraulic pressure (also referred to as an oil pressure or a fuel pressure) of the fuel, which is guided into the pressure control chamber 36, is exerted in the valve-closing of the needle.

Furthermore, the piston 31 is received in the cylinder hole 35 of the injector body 33 in the manner that enables the reciprocation of the piston 31 in the axial direction. The piston 31 exerts an axial force against the needle toward the injection hole (in the valve-closing direction).

A cylindrical fastening portion 37 is formed in an axial upper end portion of the injector body 33. A receiving space, which receives one axial end portion of the solenoid valve 150, is formed in an inside of the cylindrical fastening portion 37. Furthermore, a recess, which receives a chip packing (hereinafter referred to as an orifice plate) 41, is formed in a bottom of the cylindrical fastening portion 37. A female thread is formed in an inner peripheral surface of the cylindrical fastening portion 37 to threadably engage with a male thread of the valve body 42 of the solenoid valve 150. Furthermore, a male thread is formed in an outer peripheral surface of the cylindrical fastening portion 37 to threadably engage with a female thread of the retaining nut 43 of the solenoid valve 150.

A ring groove 38, which is configured into an annular form and receives the O-ring 24, is formed in the outer peripheral surface of the cylindrical fastening portion 37. Since the O-ring 24 is interposed between the outer peripheral surface of the cylindrical fastening portion 37 and the inner peripheral surface of the retaining nut 43, it is possible to limit the leakage of the fuel from the inside to the outside of the solenoid valve 150.

Fuel guide passages (the fuel supply passages) L2-L4 are formed in the inside of the nozzle body 32 and the inside of the injector body 33. The fuel guide passages L2-L4 guide the high pressure fuel to the fuel well and the pressure control chamber 36 from a fuel guide passage (an inlet port) L1 of a conduit joint 44, which is connected to the common rail, through a bar filter 45. The bar filter 45 filters foreign objects (e.g., foreign particles or foreign debris) contained in the fuel. The fuel guide passage L4 is a fuel passage that is communicated with the injection hole through the fuel well.

A fuel recovery passage L5 is formed in the inside of the injector body 33. Excess fuel flows into the fuel recovery passage L5 from the cylinder hole 35. The fuel recovery passage L5 is communicated with fuel leak passages L11-L17, which are formed in the inside of the solenoid valve 150.

Next, details of the main features of the solenoid valve 150 of the present embodiment will be described with reference to FIGS. 1 to 8B.

The fuel injection nozzle 110 and the solenoid valve 150 are securely fastened together to form the injector 100 by threadably fastening the retaining nut 43 to the outer peripheral surface of the cylindrical fastening portion 37 of the injector body 33 in a state where the orifice plate 41 is clamped between the injector body 33 of the fuel injection nozzle 110 and the valve body 42 of the solenoid valve 150.

The solenoid valve 150 forms a solenoid opening and closing valve of a normally closed type. Besides the above-described components (i.e., the valve 1, the coil 2, the terminals 4, 5, the resin-bonded body 6, the armature 14, the stator core 15, the non-magnetic metal case 16, the non-magnetic metal block 17, the resin-molded body 18, the dielectric bushes 21 and the O-rings 22), the solenoid valve 150 further includes the orifice plate 41, the valve body 42 and the retaining nut 43.

The orifice plate 41 is made of a non-magnetic metal material. The orifice plate 41 has an annular valve seat at a center portion of the orifice plate 41. The valve 1 is seatable against the valve seat of the orifice plate 41. Furthermore, an inlet-side orifice 46 and the outlet-side orifice (the passage hole) 47 are formed in the orifice plate 41. The inlet-side orifice 46 and the outlet-side orifice 47 adjust a flow quantity of the fuel that passes through the inlet-side orifice 46 and the outlet-side orifice 47.

The inlet-side orifice 46 is an inlet (high pressure side) flow passage hole, which communicates between the fuel guide passage L4 and the pressure control chamber 36. Furthermore, the outlet-side orifice 47 is an outlet side (low pressure side) flow passage hole, which communicates between the pressure control chamber 36 and the fuel leak passages L11-L17. The outlet-side orifice 47 forms a valve hole (a valve hole of the solenoid valve 150), which opens at the valve seat.

The valve body 42 is made of a non-magnetic metal material. A slide hole 48 is formed along a central axis of the valve body 42. The fuel leak passage L11 is formed at an opening end of the slide hole 48, which is located on the side where the orifice plate 41 is placed. An opening diameter (a passage diameter) of the fuel leak passage L11 is larger than a hole diameter of the slide hole 48.

The fuel leak passage L12 and the fuel leak passage L13 are formed in the inside of the valve body 42. The fuel leak passage L12 is tilted relative to the axial direction of the central axis of the valve body 42. The fuel leak passage L13 is generally parallel to the axial direction of the central axis of the valve body 42. Also, the fuel leak passage L13 and the slide hole 48 are generally parallel to each other and are arranged one after another in the radial direction.

The valve 1 is a valve element that is seatable against and is liftable away from the valve seat of the orifice plate 41 to respectively close and open the outlet-side orifice 47.

The valve 1 and the armature 14 are urged against the valve seat of the orifice plate 41 by the urging force of the coil spring 25.

The solenoid actuator 151 is used as a needle actuator, which controls the opening and closing operation (fuel injection operation) of the needle by increasing or decreasing the fuel pressure in the pressure control chamber 36 of the injector body 33.

The solenoid actuator 151 includes a coil sub-assembly, the armature 14, the stator core 15, the non-magnetic metal case 16, the non-magnetic metal block 17 and the resin-molded body 18. The armature 14 is slidably supported in the slide hole 48 of the valve body 42. The stator core 15 has a magnetically attracting portion (a magnetic pole surface), which magnetically attracts the armature 14. The non-magnetic metal case 16 surrounds the stator core 15 in the circumferential direction. The terminals 4 extend through the non-magnetic metal block 17. The resin-molded body 18 is a head cap (housing), which is provided at an upper portion of the injector 100 in FIG. 1.

The coil sub-assembly includes the coil 2, the terminals 4, 5 and the resin-bonded body 6.

Details of the coil sub-assembly will be described later.

The armature 14 is made of a magnetic metal material (a ferromagnetic material, such as iron), which is magnetized when the coil 2 is energized. The armature 14 includes a slidable shaft portion (an armature stem). The slidable shaft portion is a magnetic movable body, which forms a portion of a magnetic circuit that is formed in response to the energization of the coil 2. Furthermore, the slidable shaft portion is slidably and reciprocatably received in the slide hole 48 of the valve body 42. The coil spring 25 exerts the urging force to urge the armature 14 together with the valve 1 toward the valve seat of the orifice plate 41.

Furthermore, the armature 14 has an armature main body, which is opposed to the magnetic pole surface of the stator core 15 such that a predetermined gap is interposed between the armature main body and the magnetic pole surface of the stator core 15. A spring seat 51 is formed in a center portion of the armature main body. One end portion of the coil spring 25 is held by the spring seat 51. Furthermore, through-holes 52 extend through the armature main body in a direction that is substantially parallel to the armature main body. The through-holes 52 ensure smooth movement of the fuel between the front side and the rear side of the armature 14 in the fuel leak passage L14, which receives the armature 14.

The stator core 15 is made of a magnetic metal material (a ferromagnetic material, such as iron), which is magnetized when the coil 2 is energized.

The stator core 15 is a stationary magnetic body, which forms a part of the magnetic circuit that is formed in response to the energization of the coil 2. The stator core 15 has a magnetically attracting portion (a magnetic pole surface), which is configured into an annular form and magnetically attracts the armature 14. The fuel leak passage L15 is formed along the central axis of the stator core 15. A coil receiving space 53, which receives the coil sub-assembly, is formed in the stator core 15. The coil receiving space 53 includes a cylindrical space and two axial spaces. The cylindrical space receives the resin bobbin 7 and a coil element (a wound wire) of the coil 2. The axial spaces receive two conductive joints, respectively, at each of which the corresponding coil end lead 3 of the coil 2 and the corresponding terminal 4 are joined together.

The non-magnetic metal case 16 is arranged to surround the stator core 15 in the circumferential direction and holds an outer peripheral portion of the stator core 15. The non-magnetic metal case 16 has an annular flange 55. A spacer 54 is clamped between an annular end surface (an upper end surface in FIG. 2) of the cylindrical fastening portion 37 of the injector body 33 and the annular flange 55.

The stator core 15 and the non-magnetic metal block 17 are assembled together by the non-magnetic metal case 16. Specifically, the non-magnetic metal case 16 is engaged to the outer peripheral portion of the stator core 15, and the non-magnetic metal block 17 is held by the non-magnetic metal case 16 by, for example, swaging (metal bending) or welding. In this way, the stator core 15 is fixed between the non-magnetic metal case 16 and the non-magnetic metal block 17.

The non-magnetic metal block 17 is insert molded into the resin-molded body 18 such that the non-magnetic metal block 17 is installed to the end surface of the stator core 15, which is located on the axial side that is opposite from the armature 14.

A pipe holding portion 57, which is configured into a cylindrical form, is formed in the non-magnetic metal block 17. A non-magnetic pipe 56 is press fitted into the pipe holding portion 57. A top return tube 58, which is configured into a cylindrical form, is formed on an upper end side of the pipe holding portion 57 in FIG. 2.

The fuel passage L16 is formed in the inside of the non-magnetic pipe 56.

The top return tube 58 is connected to a fuel return conduit, though which the fuel leaked from the inside of the injector 100 is returned to a fuel tank.

The fuel leak passage (an outlet port) L17 is formed in the inside of the top return tube 58.

A ring groove 59, which is configured into an annular form, is formed in the outer peripheral surface of the non-magnetic metal block 17 and receives the O-ring 23. Since the O-ring 23 is interposed between the outer peripheral surface of the non-magnetic metal block 17 and the inner peripheral surface of the retaining nut 43, it is possible to limit the leakage of the fuel from the inside to the outside of the solenoid valve 150.

The resin-molded body 18 seals the conductive joins of the terminals 4, 5 and base portions of the terminals 5 through insert molding.

A lateral portion of the resin-molded body 18 forms a connector case 26, which receives distal end portions of the terminals 5 such that the distal end portions of the terminals 5 are exposed in an internal space in the connector case 26. A hood portion of the connector case 26 extends in an engaging direction (a connecting direction), along which the food portion of the connector case 26 is engaged, i.e., connected to a corresponding mating connector (a corresponding external connector).

The one axial end portion of the coil spring 25 is supported by the spring seat 51, which is formed in the upper end surface of the armature 14. The other axial end portion of the coil spring 25 is supported by a lower end surface of the non-magnetic pipe 56, which is fitted into the non-magnetic metal block 17.

Next, a coil assembly of the present embodiment will be described in detail with reference to FIGS. 1 to 8B.

The coil assembly includes the coil 2, the terminals 4, 5, the resin-bonded body 6, the stator core 15, the non-magnetic metal block 17 and the resin-molded body 18.

Figure 7A:
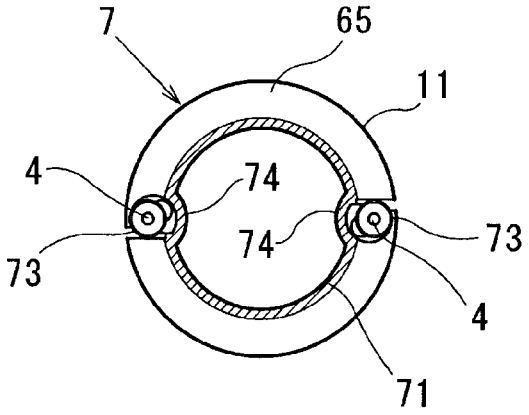
FIG. 7A is a plan view showing a surface-modified portion on the upper surface of the resin bobbin according to the first embodiment.
Figure 7B:
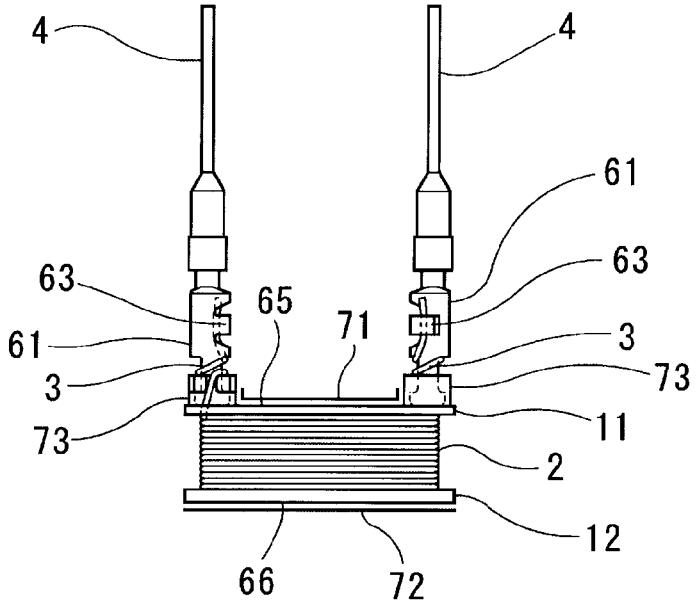
FIG. 7B is a schematic side view showing the surface-modified portion on the upper surface of the resin bobbin and a surface-modified portion on the lower surface of the resin bobbin according to the first embodiment.

Among these components, the coil sub-assembly includes the coil 2, the terminals 4 and the resin-bonded body 6 (see FIGS. 5 and 7).

The coil 2 is placed in the cylindrical space (the coil receiving space) of the stator core 15 along with the resin bobbin 7 and the resin mold 8, which form the resin-bonded body 6.

The coil 2 is the solenoid coil that includes the conductive wire, which has a circular cross-section and is wound multiple times around the resin bobbin 7. The coil 2 serves as a magnetic flux generating device (a magnetism generating device), which generates a magnetic force to magnetically attract the armature 14 to the magnetically attracting portion (the magnetic pole surface) of the stator core 15 when the electric power is supplied to the coil 2 to energize the same.

The coil 2 exerts the magnetic force to drive the valve 1 and the armature 14 toward the one axial side (the upper side in FIGS. 1 and 2) in the axial direction of the valve 1 and the armature 14. When the coil 2 is energized, the magnetic circuit is formed to conduct the magnetic flux. The magnetic flux mainly flows through the armature 14 and the stator core 15 in the magnetic circuit.

The coil 2 includes the coil element (the wound wire) and the two coil end leads 3. The coil element is wound around the resin bobbin 7. The coil end leads 3 respectively extend from a winding start end portion and a winding terminal end portion of the coil element. An outer peripheral portion of the coil 2, the conductive joints (the coil lead conductive connections, which are also referred to as primary connections) 61 and the conductive joints (the connector terminal conductive connections, which are also referred to as secondary connections) 62 are covered by and protected by the thermoset (EP) resin mold 8 and the thermoplastic (PPS) resin-molded body 18. Each of the joints 61 connects between the corresponding coil end lead 3 of the coil 2 and a primary connective end portion of the corresponding terminal 4. Each of the joints 62 connects between a secondary connective end portion of the corresponding terminal 4 and a tertiary connective end portion of the corresponding terminal 5.

Each of the two coil end leads 3 is electrically connected to the primary connective end portion of the corresponding one of the two terminals 4 through swaging (metal bending) or welding.

The terminals 4, 5 are formed as metal conductors made of, for example, a copper alloy or an aluminum alloy. The surface of each of the terminals 4, 5 is phosphor bronze, tin plated.

Each of the terminals 4 is formed as a relay conductive member (a primary connective member) that linearly extends from the primary connective end portion of the terminal 4, which is electrically connected to the coil end lead 3, to the secondary connective end portion of the terminal 4, which is electrically connected to the corresponding terminal 5.

The joint 61 of each terminal 4, which is connected to the corresponding coil end lead 3, is inserted into the inside of the resin mold 8.

The terminals 4 are inserted through the receiving holes 19 of the non-magnetic metal block 17. A lead hook 63 is formed in each of the terminals 4 to hold an excess portion of the corresponding coil end lead 3.

Each terminal 4 is electrically connected to the tertiary connective end portion of the corresponding terminal 5 in the corresponding joint 62 by, for example, welding.

Each of the terminals 5 is formed as an external connective member (a secondary connective member) that is bent and extends from the tertiary connective end portion of the terminal 5, which is electrically connected to the corresponding terminal 4, to a quaternary connective end portion (a connector end portion) of the terminal 5, which is exposed in the internal space in the connector case 26.

The tertiary connective end portion of each terminal 5, which is connected to the corresponding terminal 4, is inserted into the inside of the resin-molded body 18. The quaternary connective end portion of each terminal 5 forms an exposed portion of the terminal 5, which is exposed from the base portion of the resin-molded body 18 into the internal space of the connector case 26.

A portion of each terminal 4, which is opposite from the coil 2, is protected by the corresponding dielectric bush 21. The dielectric bush 21 is made of a dielectric thermoplastic resin material (e.g., polyamide resin, which is abbreviated as PA) and is configured into a cylindrical tubular body.

Each of the two dielectric bushes 21 is inserted into the corresponding receiving hole 19 of the non-magnetic metal block 17 to electrically insulate between the corresponding terminal 4 and the non-magnetic metal block 17.

A through-hole 64 extends through each dielectric bush 21 to receive the corresponding terminal 4. Each dielectric bush 21 has a large cylindrical tubular portion (a large diameter portion), a frustum tubular portion (an intermediate diameter portion) and a small cylindrical tubular portion (a small diameter portion), which are arranged in this order from the one side, at which the coil 2 is located, to the other side, which is opposite from the coil 2. An outer diameter of the large cylindrical tubular portion (the large diameter portion) is larger than an outer diameter of the small cylindrical tubular portion (the small diameter portion). Furthermore, an outer diameter of the frustum tubular portion (the intermediate diameter portion) is smaller than the outer diameter of the large cylindrical tubular portion (the large diameter portion) and is larger than the outer diameter of the small cylindrical tubular portion (the small diameter portion).

A large diameter hole, which is communicated with the coil receiving space 53 of the stator core 15, is formed at a stator core 15 side end portion of each receiving hole 19. Furthermore, a small diameter hole, which has an inner diameter that is smaller than an inner diameter of the large diameter hole, is formed in the other end portion of the receiving hole 19, which is opposite from the stator core 15. An intermediate diameter hole, which includes a frustum hole section and a circular hole section, is formed in an intermediate portion of the receiving hole 19 to communicate between the large diameter hole and the small diameter hole.

The O-ring 22, which is made of oil resistant synthetic rubber, is installed between an outer peripheral surface of the small diameter portion of each dielectric bush 21 and an inner peripheral surface of the intermediate diameter hole (the circular hole section) of the corresponding receiving hole 19 to limit leakage of the fuel from the inside to the outside of the solenoid valve 150.

Next, details of the resin-bonded body 6 will be described with reference to FIGS. 1 to 8B.

The resin-bonded body 6 is installed to the solenoid actuator 151 of the solenoid valve 150. The resin-bonded body 6 is formed by boding between a resin surface of the resin bobbin 7 and a resin surface of the resin mold 8. The resin bobbin 7 is configured into a hollow cylindrical tubular body and, and the coil element of the coil 2 is wound around the resin bobbin 7. The resin mold 8 seals the coil 2, the resin bobbin 7 and the terminals 4 therein.

The resin-bonded body 6 has fuel seal portions 67, 68, each of which is configured into an annular form and limits leakage of the fuel from a corresponding boundary surface 65, 66 between the resin bobbin 7 and the resin mold 8 to the outside (exterior) of the solenoid valve 150 to improve a degree of sealing between the resin bobbin 7 and the resin mold 8.

The fuel seal portion 67 has a first surface-modified portion (hereinafter referred to as a surface-modified portion) 71, which improves, i.e., increases a degree of bonding and a degree of adhesion between a resin surface (hereinafter referred to as an upper surface) of the flange 11 of the resin bobbin 7 and a resin surface (hereinafter referred to as a first opposing surface) of the resin mold 8. The surface-modified portion 71 is formed by applying a surface modification process (a plasma irradiation process or an ultraviolet irradiation process) on a portion of the upper surface of the flange 11. The surface modification process (the plasma irradiation process or the ultraviolet irradiation process) improves wettability and hydrophilicity of the resin surface. Furthermore, the surface-modified portion 71 is surface-modified to have an oxygen-containing functional group (e.g., —OH, —COOH), which can form a chemical bond (particularly a covalent bond) with a copolymer of the resin mold 8, i.e., the thermoset resin material.

The fuel seal portion 68 has a second surface-modified portion (hereinafter referred to as a lower surface-modified portion) 72, which improves a degree of bonding and a degree of adhesion between a resin surface (hereinafter referred to as a lower surface) of the flange 12 of the resin bobbin 7 and a resin surface (hereinafter referred to as a second opposing surface) of the resin mold 8. The surface-modified portion 72 is formed by applying the surface modification process (the plasma irradiation process or the ultraviolet irradiation process) on the entire lower surface of the flange 12. The surface modification process (the plasma irradiation process or the ultraviolet irradiation process) improves the wettability and the hydrophilicity of the resin surface. Furthermore, the surface-modified portion 72 is surface-modified to have an oxygen-containing functional group (e.g., —OH, —COOH), which can form a chemical bond (particularly a covalent bond) with the copolymer of the thermoset resin material like the surface-modified portion 71.

The resin bobbin 7 is formed integrally from a thermoplastic resin material (e.g., polyphenylene sulfide resin, which is abbreviated as PPS, or syndiotactic polystyrene resin, which is abbreviated as SPS) that has at least a C—H bond, which is a hydrocarbon compound.

Here, the PPS or the SPS is the polymer, in which sulfur is joined to a benzene ring having a C—H bond. This resin has good dielectricity, good heat resistance and hard-to-bond property (i.e., this resin material being a hard-to-bond resin material also known as hard-to-bond plastic).

The resin bobbin 7 is installed in a cylindrical portion of the coil receiving space 53. The resin bobbin 7 has the hollow portion 10, the flanges 11, 12 and the winding core portion 13.

The conductive wire, which is coated with the dielectric film, is wound multiple times around the winding core portion 13 between the flange 11 and the flange 12.

The flange 11 is a first flange, which is configured into an annular form and radially outwardly projects from one axial end part (an upper end part in FIG. 2) of the winding core portion 13. The first opposing surface of the resin mold 8 is bonded to a portion of the upper surface of the flange 11.

The flange 12 is a second flange, which is configured into an annular form and radially outwardly projects from the other axial end part (a lower end part in FIG. 2) of the winding core portion 13. The second opposing surface of the resin mold 8 is bonded to the lower surface of the flange 12.

Two terminal guides 73 are formed integrally with the flange 11 of the resin bobbin 7. The terminal guides 73 are configured to have an arcuate cross section and hold the terminals 4, respectively. The terminal guides 73 are placed at the corresponding locations, respectively, which correspond to the terminals 4, respectively. In the present embodiment, the terminal guides 73 are circumferentially displaced from each other by about 180 degrees. Each of the terminal guides 73 is a cylindrical column that linearly projects upward from the upper surface of the flange 11 in FIGS. 1 to 4 and 5B.

Figure 5A:
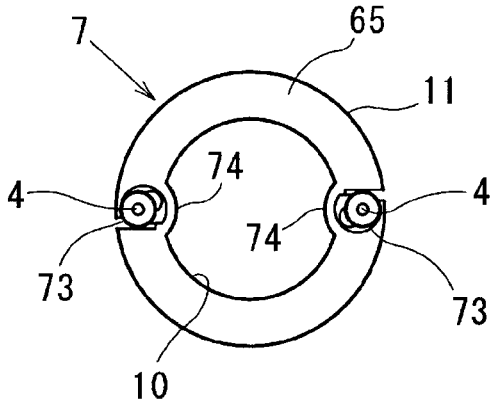
FIG. 5A is a plan view showing an upper surface of the resin bobbin of the first embodiment.

As shown in FIG. 5A, two curved projections 74 are formed in an inner peripheral surface of the flange 11 at corresponding two locations, respectively, which are adjacent to the terminal guides 73, respectively, on the radially inner side thereof to bypass the terminal guides 73.

Two curved projections 75 are formed in an inner peripheral surface of the flange 12 at corresponding two locations, respectively.

A connecting portion 76 of each terminal 4 is joined to a distal end of the corresponding terminal guide 73 through swaging.

The resin mold 8 is formed integrally from a thermoset resin material (e.g., epoxy, which is abbreviated as EP) that is produced upon solidification thereof through cross-linking of an epoxy group in a polymer by a curing agent.

The EP is a copolymer of bisphenol-A and epichlorohydrin (bisphenol-A epoxy resin). This resin has the good dielectricity and the size stability.

Besides the bisphenol-A epoxy resin, the epoxy resin can be novolack epoxy resin or cycloaliphatic epoxy resin. The novolack epoxy resin has a relatively large number of functional groups. The cycloaliphatic epoxy resin does not have the benzene ring.

The resin mold 8, the coil 2 and the resin bobbin 7 are received in the coil receiving space 53, which is formed in the stator core 15.

The resin mold 8 has the first opposing surface and the second opposing surface. The first opposing surface adheres to the upper surface of the flange 11, and the second opposing surface adheres to the lower surface of the flange 12.

The resin mold 8 has a cylindrical tubular portion 79, two axially extending portions 77 and two widening portions 78. The cylindrical tubular portion 79 surrounds the outer peripheral portion of the coil 2, the outer peripheral portion of the flange 11 and the outer peripheral portion of the flange 12 in the circumferential direction. The axially extending portions 77 axially project from the cylindrical tubular portion 79 toward the upper side in FIGS. 1 to 4 and 5B. Each of the widening portions 78 axially projects from an axial distal end part of the corresponding one of the axially extending portions 77 and has an enlarged width (enlarged diameter), which is measured in a direction perpendicular to the axial direction and is larger than an outer diameter of the axially extending portion 77. Furthermore, each widening portion 78 is received in the corresponding receiving hole 19 of the non-magnetic metal block 17.

The cylindrical tubular portion 79 covers and protects the outer peripheral portion of the coil 2 and the outer peripheral portions of the flanges 11, 12.

Each of the axially extending portions 77 covers and protects the conductive joint between the corresponding coil end lead 3 and the corresponding terminal 4.

Each of the widening portions 78 projects from a distal end surface (an end surface located on the side opposite from the coil 2) of the corresponding axially extending portion 77 toward the upper side in FIGS. 1 to 5. A cross-sectional area of the receiving hole 19 is larger than a cross-sectional area of the axial space of the coil receiving space 53. Therefore, the widening portion 78 is widened in the direction perpendicular to the axial direction in comparison to the axially extending portion 77.

Next, there will be described the solenoid actuator 151 that includes the resin-bonded body 6 made of the first synthetic resin material and the second synthetic resin material, which have different properties, respectively, and are bonded together. More specifically, there will be described the manufacturing method of the coil assembly that at least includes the coil 2, the resin bobbin 7 and the resin mold 8.

First of all, the thermoplastic resin material, more specifically, the PPS is heated and is thereby molten. This thermoplastic resin material, i.e., the PPS has the property, which is different from the property of the thermoset resin material, more specifically the EP. Then, the molten resin material, i.e., the PPS is pressurized and injected into a bobbin cavity (a cavity that is configured into a shape that corresponds to a product shape of the resin bobbin 7) in a PPS molding die. Thereafter, the cooled molded resin product, i.e., the resin bobbin 7 is removed from the PPS molding die. Through the use of the injection molding method described above, the resin bobbin 7, which is configured into the hollow cylindrical tubular body and includes the flanges 11, 12 and the winding core portion 13, is formed (a first step).

Next, a conductive wire, which is coated with a dielectric film, is wound multiple times around the winding core portion 13 between the flanges 11, 12 of the resin bobbin 7, so that a coil component, which has the coil 2 wound around the resin bobbin 7, is formed (a second step).

Next, an end portion of each of the coil end leads 3, which are pulled out from the flange 11 of the resin bobbin 7, is joined to the primary conductive end portion of the corresponding terminal 4 in a manner that enables the electrical connection therebetween. In this way, the coil end leads 3 are mechanically and electrically connected to the primary conductive end portions of the terminals 4, respectively, through the joints 61 (a third step).

Figure 5B:
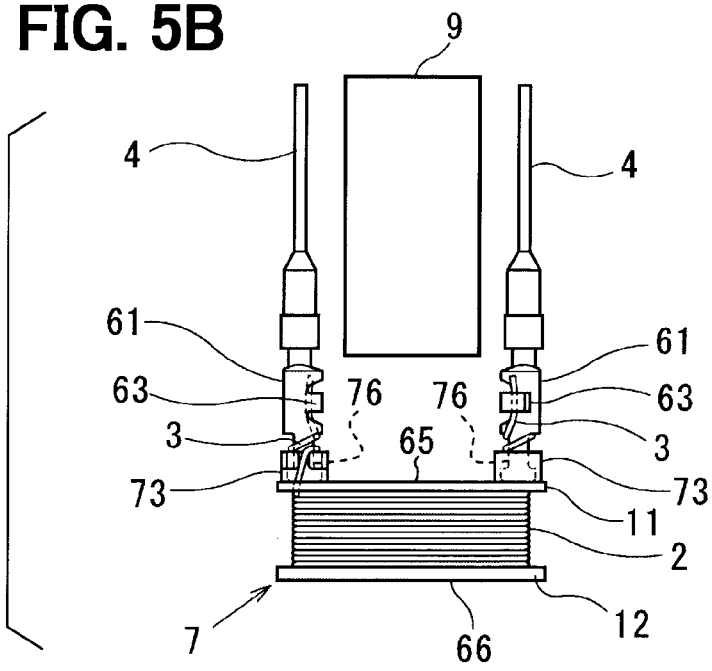
FIG. 5B is a schematic side view showing a surface modification process (a plasma irradiation process) applied to the upper surface of the resin bobbin.
Figure 5C:
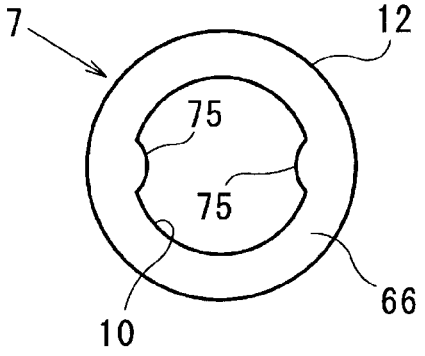
FIG. 5C is a plan view showing a lower surface of the resin bobbin of the first embodiment.

When the first to third steps are executed, the coil sub-assembly shown in FIGS. 5A to 5C is formed.

Next, the surface modification process (the plasma irradiation process) shown in FIGS. 6A to 8B is performed on the portions of the boundary surfaces 65, 66 between the resin bobbin 7 and the resin mold 8. Specifically, the surface modification process (the plasma irradiation process) shown in FIGS. 6A to 8B is performed on the portion of the upper surface of the flange 11 and the entire lower surface of the flange 12 of the resin bobbin 7. Thereby, the surface-modified portions 71, 72 are formed in the upper surface of the flange 11 and the lower surface of the flange 12, respecitively, (a fourth step). Each surface-modified portion 71, 72 is surface-modified to have the oxygen-containing functional group (—OH or —COOH), which can make the chemical bond (e.g., the covalent bond, the ion bond or hydrogen bond) with the copolymer of the thermoset resin, i.e., the EP. The depth of the surface-modified portions 71, 72 is a predetermined depth (e.g., about 2 to 3 nm) from the resin surface.

Next, the coil sub-assembly is inserted into the coil receiving space 53 of the stator core 15. Then, the stator core 15 and the coil sub-assembly are positioned in a cavity of an EP molding die.

Thereafter, the thermoset resin material, i.e., the EP, which is the material of the resin bobbin 7 and has the property different from that of the PPS, is throughly filled into the cavity of the EP molding die. Then, the filled thermoset resin material, i.e., the EP is solidified by heating the EP molding die, so that the resin mold 8, which has the cylindrical tubular portion 79, the two axially extending portions 77 and the two widening portions 78, is formed (a fifth step).

At the fifth step, the portions of the first and second opposing surfaces of the resin mold 8 are chemically bonded (forming the covalent bond, the ion bond or the hydrogen bond) with the surface-modified portions 71, 72, respectively. Thereby, the annular fuel seal portions 67, 68 are respectively formed in the portions of the boundary surfaces 65, 66 between the resin bobbin 7 and the resin mold 8.

Figure 8A:
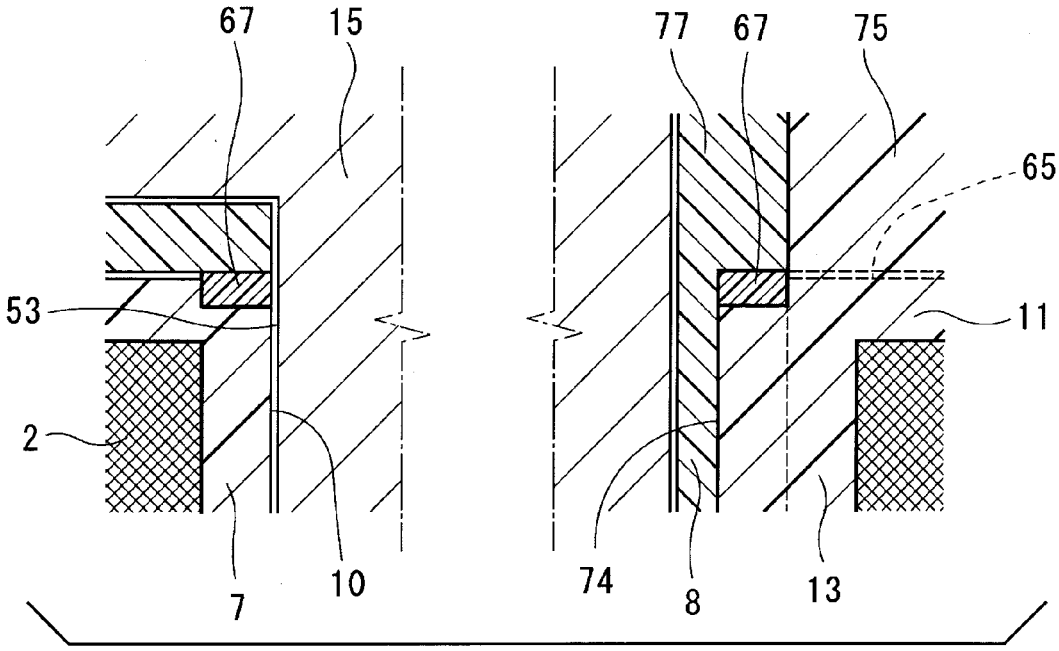
FIG. 8A is a partial enlarged cross-sectional view showing a fuel seal portion formed in a boundary surface between the resin bobbin and the resin mold on the upper side of the coil according to the first embodiment.
Figure 8B:
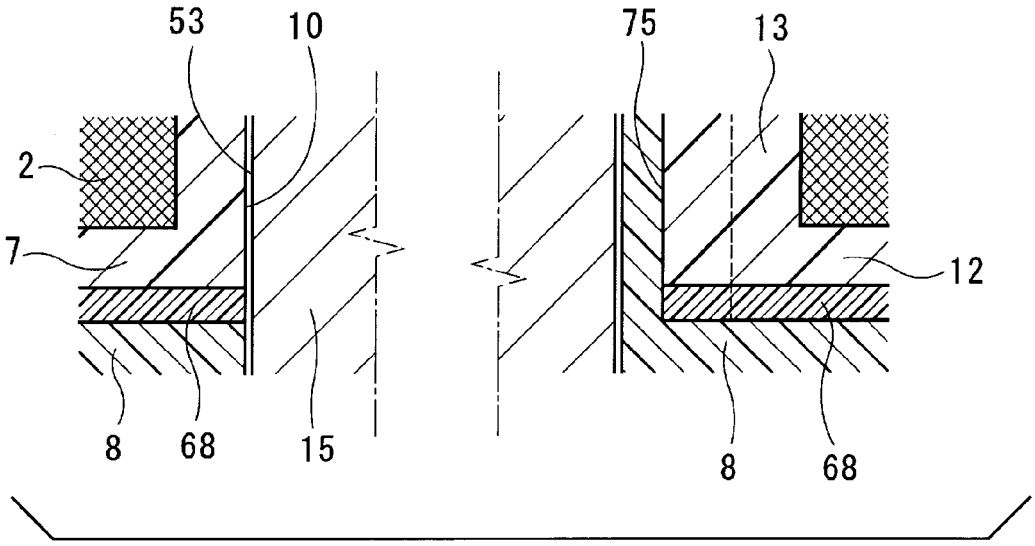
FIG. 8B is a partial enlarged cross-sectional view showing a fuel seal portion formed in a boundary surface between the resin bobbin and the resin mold on the lower side of the coil according to the first embodiment.

When the first to fifth steps are completed, the coil assembly shown in FIGS. 8A to 8B is formed.

Next, the surface modification method for performing the surface modification process through the plasma irradiation by using a plasma generating device will be described with reference to FIGS. 1 to 8B.

FIGS. 5A to 6E show a plasma nozzle 9 and jigs 81-83. The plasma nozzle 9 irradiates the plasma onto each corresponding surface of the resin bobbin 7.

A discharge structure is placed in an inside of the plasma nozzle 9. In the discharge structure, two dielectric bodies, such as quartz bodies are held between two opposed metal electrodes. Furthermore, a high frequency and high voltage source is connected to one of the two metal electrodes. An oxygen gas is supplied from an oxygen tank to a discharge space, which is formed between the dielectric bodies.

While a plasma generating gas (e.g., the oxygen gas) is supplied to the discharge space, which is held under a pressure that is equal to or around the atmospheric pressure or a vacuum pressure, a predetermined high frequency and high voltage (e.g., a frequency=13.56 MHz, AC power=130 to 160 W, a total irradiation time=1 to 5 seconds) is applied between the metal electrodes. Thereby, the plasma discharge is generated in the oxygen gas supplied to the discharge space. At this time, the plasma generating gas (e.g., the oxygen gas) is excited, and thereby the plasma is generated.

The plasma, which is discharged from a distal end injection opening of the plasma nozzle 9, is radially spread by the jig 81-83 in a radial direction about a central axis of the flange 11. Thereby, the plasma is spread in an annular pattern and is applied to the upper surface of the flange 11 along an inner peripheral edge portion of the flange 11 (see a shaded portion in FIG. 7A).

Figure 7C:
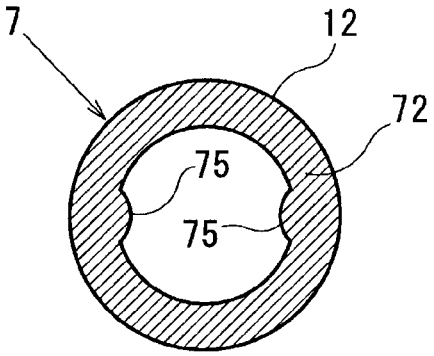
FIG. 7C is a plan view showing the surface-modified portion on the lower surface of the resin bobbin according to the first embodiment.

Furthermore, the plasma, which is discharged from the distal end discharge opening of the plasma nozzle 9, is spread in an annular pattern and is applied to the entire lower surface of the flange 11 (see the shaded portion in FIG. 7C).

As discussed above, the resin bobbin 7 is made of the PPS. The PPS has the benzene ring having the C—H bond.

The bond between the carbon atom and the hydrogen atom is cut through a chemical reaction, which is induced by the applied plasma, in the portion of the upper surface of the flange 11 and the entire lower surface of the flange 12.

Then, the surface-modified portions 71, 72 are formed in the portion of the upper surface of the flange 11 and the entire lower surface of the flange 12, respectively, to have the oxygen-containing functional group such as —OH, —COOH, which can be chemically bonded (forming, for example, the covalent bond) with the copolymer of the EP.

In this way, even though the resin bobbin 7 is made of the PPS, which has the hard-to-bond property and is thereby called the hard-to-bond resin material (or hard-to-bond plastic), the wettability and the hydrophilicity of each surface-modified portion 71, 72 of the resin bobbin 7 are improved, i.e., increased to enable effective bonding of the surface-modified portions 71, 72 relative to the resin mold 8, which is made of the EP.

In this particular instance, an outer diameter of each of the flanges 11, 12 is 9.1 mm, and an inner diameter of the winding core portion 13 is 5.7 mm. Furthermore, an axial height of each flange 11, 12 is 1.7 mm.

Furthermore, in the plasma generating device of the present embodiment, a distance from the distal end of the plasma nozzle 9 to the upper surface of the flange 11 or the inverted lower surface of the flange 12 is set to be equal to or larger than 1 mm and is equal to or smaller than 10 mm.

Figure 6A:
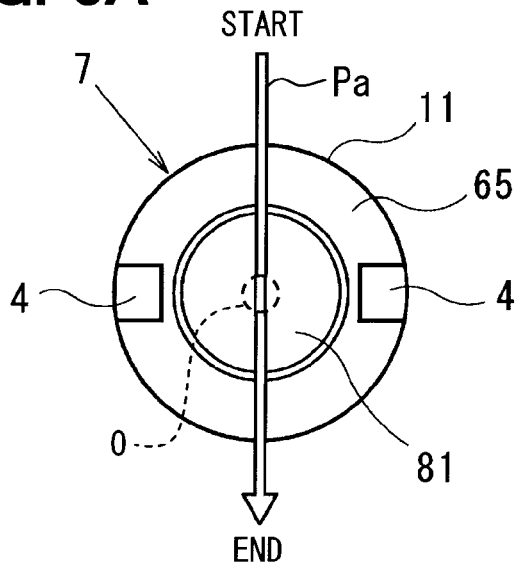
FIG. 6A is a schematic diagram showing the surface modification process (the plasma irradiation process) applied to the upper surface of the resin bobbin according to the first embodiment.
Figure 6B:
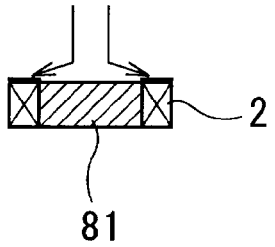
FIG. 6B is a cross-sectional view showing one example of a jig used in the process of FIG. 6A.
Figure 6D:
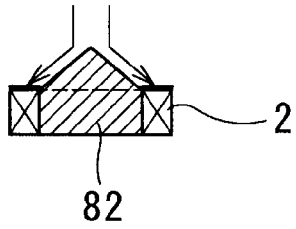
FIG. 6D is a schematic diagram showing another example of a jig used in the process of FIG. 6A.

Furthermore, with reference to FIG. 6A, the movement of the plasma nozzle 9 (the relative movement of the plasma nozzle 9 relative to the resin bobbin 7, more specifically the upper surface of the flange 11) along a straight moving path Pa is stopped, i.e., is paused for a predetermined time period (e.g., about one to five seconds) from the time of reaching a stop position O shown in FIG. 6A. In this way, the surface-modified portion 71, which is configured into an annular form, can be formed in the upper surface of the flange 11.

Furthermore, with reference to FIG. 6A, the plasma nozzle 9 is placed above the resin bobbin 7 (more specifically above the upper surface of the flange 11) and is horizontally moved at a predetermined moving speed (e.g., a moving speed of about 10 to 30 mm per second) along the straight moving path Pa until the plasma nozzle 9 reaches the stop position O shown in FIG. 6A. The plasma may be irradiated to the upper surface of the flange 11 and the inverted lower surface of the flange 12 by downwardly moving the plasma nozzle 9 in the vertical direction.

With reference to FIG. 6A, the corresponding jig 81-83 (FIG. 6A showing the jig 81) is placed on the radially inner side of the winding core portion 13. The jig 81-83 is made of a synthetic resin material, and a shape of an upper surface of the jig 81-83 may be appropriately selected from, for example, the surfaces of the jigs 81-83 shown FIGS. 6B to 6E. Specifically, an upper surface of the jig 81 shown in FIG. 6B has a flat surface, and an upper surface of the jig 82 shown in FIG. 6D has a conical surface. Furthermore, an upper surface of the jig 83 shown in FIG. 6E has a spherical (SR) shape. In the plasma irradiation process of the present embodiment, the appropriately selected corresponding jig 81-83 is placed on the radially inner side of the winding core portion 13 of the resin bobbin 7, and the plasma is irradiated on the corresponding surface of the resin bobbin 7 (the upper surface of the flange 11 or the lower surface of the flange 12). Therefore, the efficiency of the surface modification process becomes high, thereby resulting in the high productivity.

Furthermore, in the present embodiment, the oxygen gas is used as the plasma generating gas. Alternatively, a gas, which includes a nitrogen gas or air, may be used as the plasma generating gas. Further alternatively, a gas mixture of two or more gases, which are selected from the oxygen gas, the nitrogen gas and the air, may be used as the plasma generating gas. Further alternatively, a gas mixture of two or more gases, which are selected from the oxygen gas, the nitrogen gas, the air and another gas (argon or xenon), may be used as the plasma generating gas.

The ambient pressure at the time of executing the plasma irradiation may be effectively set to the atmospheric pressure or the vacuum pressure.

In the present embodiment, in a case where the outer diameter of the plasma nozzle 9 is 7 mm or 5 mm, and the inner diameter of the plasma nozzle 9 is 3 mm, the output power of plasma may be effectively set to, for example, 90 to 130 W.

When the coil 2, the resin bobbin 7 and the terminals 4 are resin molded with the resin mold 8 after the execution of the plasma irradiation process discussed above, the adhesive force of the EP to the PPS can implement the share bond strength of 3 MPa or higher.

Furthermore, according to the present embodiment, the surface modification process can improve the adhesion between the resin bobbin 7, which has the hard-to-bond property, and the resin mold 8, to achieve the bonding strength that would result in a cohesion failure of the bond between the PPS and the EP.

According to the present embodiment, as shown in FIGS. 6A, 7A and 8A, when the plasma is irradiated from the plasma nozzle 9 onto the portion of the upper surface of the flange 11 while horizontally moving the plasma nozzle 9 along the straight moving path Pa (see FIG. 6A), the surface-modified portion 71, which is configured into the annular form, is formed on the portion (the inner peripheral edge portion) of the upper surface of the flange 11.

Figure 6C:
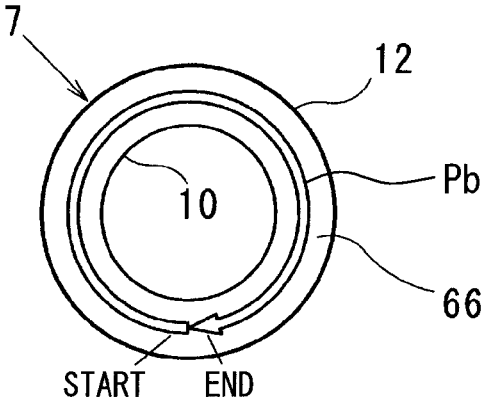
FIG. 6C is a schematic diagram showing the surface modification process (the plasma irradiation process) applied to the lower surface of the resin bobbin according to the first embodiment.
Figure 6E:
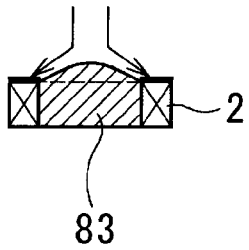
FIG. 6E is a schematic diagram showing another example of a jig used in the process of FIG. 6A.

Furthermore, as shown in FIGS. 6C, 7C and 8B, when the plasma is irradiated from the plasma nozzle 9 onto the entire lower surface of the flange 12 while horizontally moving the plasma nozzle 9 along a circular moving path Pb (see FIG. 6C), the surface-modified portion 72, which is configured into the annular form, is formed on the entire lower surface of the flange 12.

Furthermore, the solenoid valve 150, particularly the coil assembly has the resin-bonded body 6 that includes the fuel seal portions 67, 68, each of which limits the leakage of the fuel from the corresponding boundary surface 65, 66 between the resin bobbin 7 and the resin mold 8 to the outside.

Next, an operation of the injector 100 of the present embodiment will be briefly described with reference to FIGS. 1 to 5C.

When the coil 2 of the solenoid valve 150 of the injector 100 is energized, the magnetic attractive force is generated to magnetically attract the armature 14 toward the coil 2 and the stator core 15. The armature 14 is magnetically attracted to the magnetic pole surface of the stator core 15 by this magnetic attractive force. Thereby, the armature 14 is moved to a full-lift position.

At this time, the high pressure fuel is guided from the common rail into the pressure control chamber 36, which is located on the upstream side of the valve 1 in the flow direction of the fuel, through the inlet-side orifice 46. Furthermore, the fuel leak passage L11, which is located on the downstream side of the valve 1 in the flow direction of the fuel, is communicated with the fuel tank through the fuel leak passages L12-L17.

Therefore, since the fuel pressure on the upstream side of the valve 1 is higher than the fuel pressure on the downstream side of the valve 1, the valve 1 is lifted away from the valve seat of the orifice plate 41 upon the upward movement of the armature 14 in the axial direction. Thereby, the outlet-side orifice 47 of the orifice plate 41 is opened.

Figure 2:
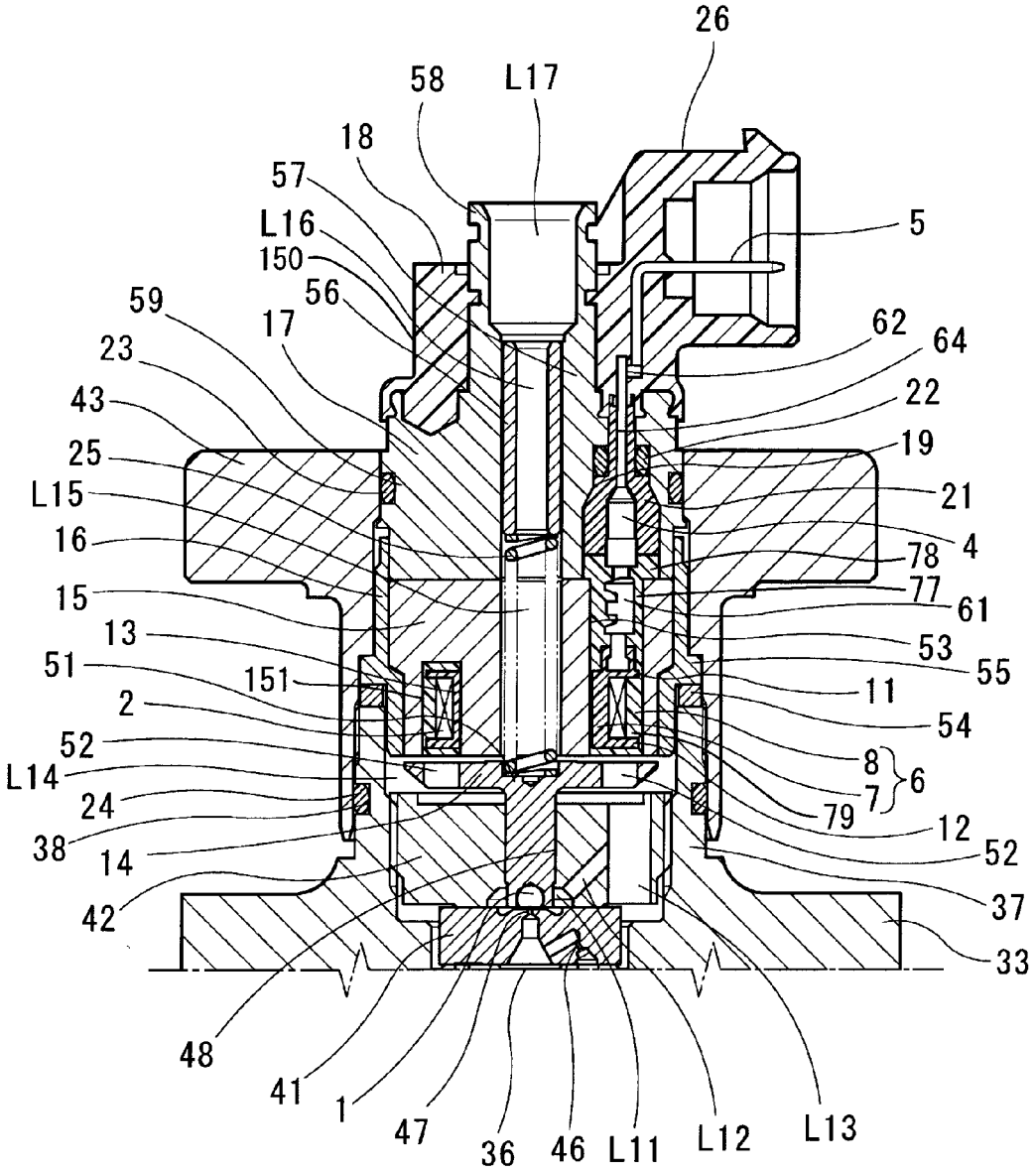
FIG. 2 is a cross-sectional view showing a solenoid valve of the injector of the first embodiment.
Figure 3:
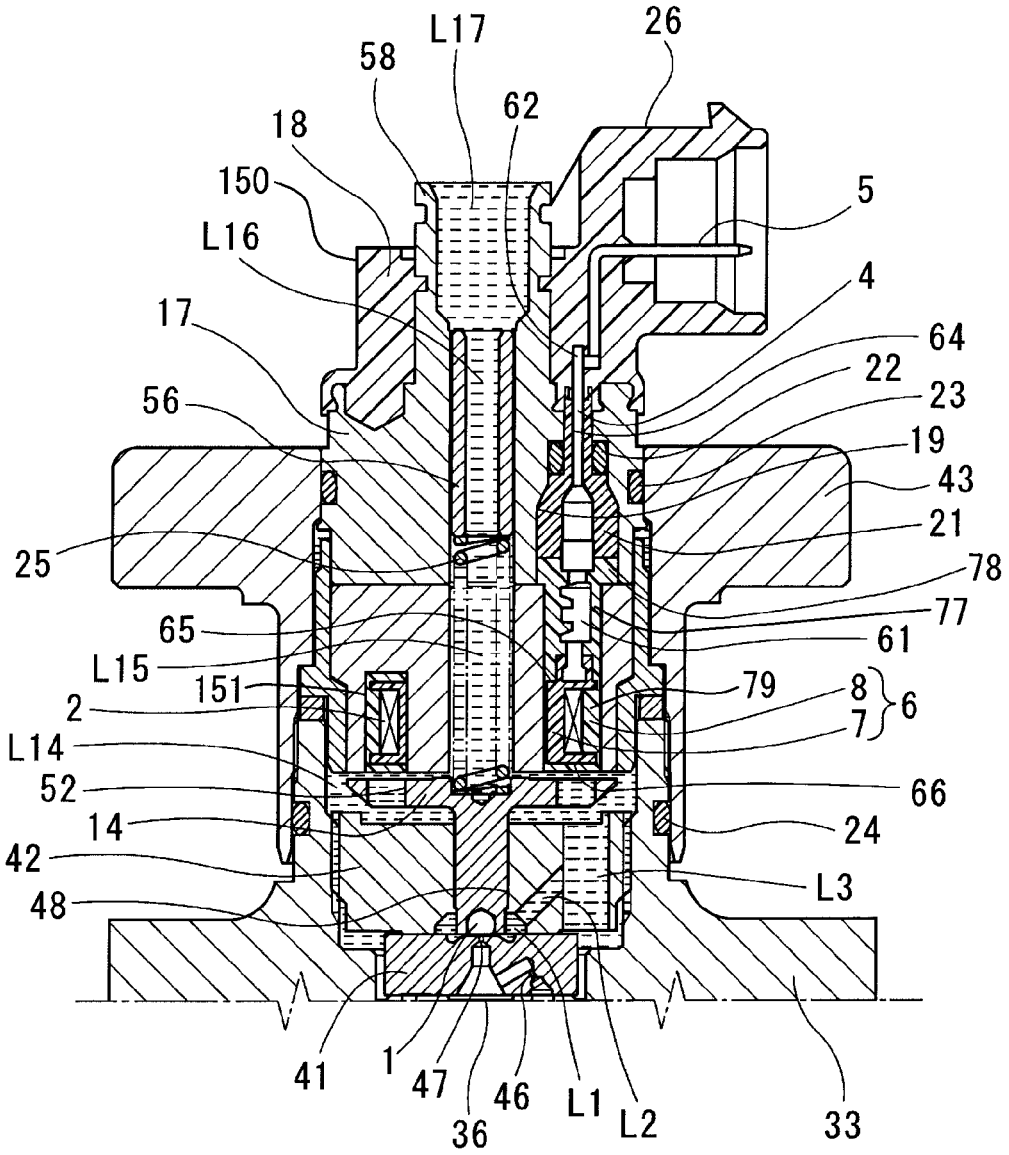
FIG. 3 is a cross-sectional view showing a fuel leak passage of the solenoid valve of the injector of the first embodiment.
Figure 4:
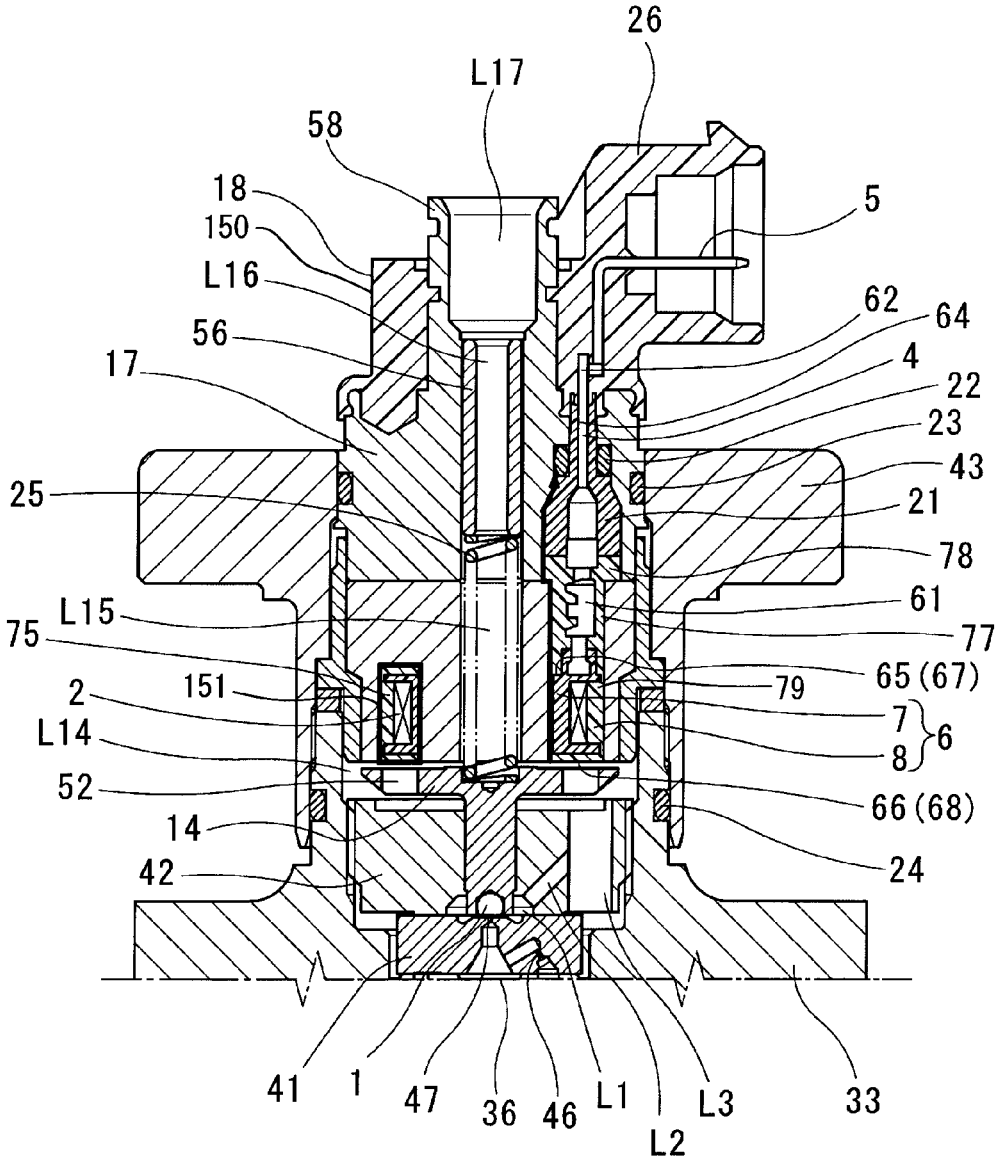
FIG. 4 is a cross-sectional view showing a fuel leak passage from a boundary between a resin bobbin and a resin mold of a solenoid actuator to an outside according to the first embodiment.

Thus, as indicated in FIGS. 1 to 3, the fuel, which is filled in the pressure control chamber 36, is returned to the fuel tank through the outlet-side orifice 47 and the fuel leak passages L11-L17.

In response to the above-described valve opening movement of the solenoid valve 150, the fuel pressure of the pressure control chamber 36, i.e., the hydraulic force (the valve closing force F1), which urges the needle in the downward direction (the valve-closing direction), is reduced. Thus, the fuel pressure of the fuel well, i.e., the hydraulic force (the valve opening force F3), which urges the needle in the upward direction (the valve-opening direction), becomes larger than a resultant force of the valve closing force F1 and the urging force of the coil spring, i.e., the spring load (the valve closing force F2) exerted in the downward direction (the valve-closing direction) on the needle.

That is, there is established the following relationship: F1+F2<F3.

In this way, the needle is lifted away from the nozzle seat of the nozzle body 32, and thereby the injection hole is opened. As a result, the injector 100 starts the injection of the fuel into the combustion chamber of the engine.

When the commanded injection period is elapsed since the injection timing, the energization of the coil 2 of the solenoid valve 150 is stopped. Thus, the armature 14 is moved by the urging force of the coil spring 25 in a direction away from the magnetic pole surface of the stator core 15. Thereby, as shown in FIGS. 1 to 3, the valve 1 is urged against the valve seat of the orifice plate 41. In this way, the outlet-side orifice 47 is closed. Thus, the high pressure fuel is supplied from the common rail to the pressure control chamber 36 through the fuel guide passages L1, L2, and thereby the pressure control chamber 36 is filled with the high pressure fuel.

As discussed above, when the solenoid valve 150 is closed, the fuel pressure (the valve closing force F1) of the fuel in the pressure control chamber 36 is rapidly increased, so that there is established the following relationship: F1+F2>F3. Thus, the needle is moved in the valve-closing direction. As a result, in the injector 100, the needle is seated against the nozzle seat of the nozzle body 32. Thereby, the injection hole is closed. Specifically, the needle is returned to the valve closing state (fully closed state). Thereby, the injection of the fuel into the combustion chamber of the engine is terminated.

Now, advantages of the first embodiment will be described.

As discussed above, according to the plasma irradiation method of the present embodiment, the surface modification process (the plasma irradiation process), i.e., the process of hydrophilization is applied to the portions of the boundary surfaces 65, 66 between the resin bobbin 7 and the resin mold 8, so that the fuel seal portions 67, 68, which limit the leakage of the fuel from the boundary surfaces 65, 66 between the resin bobbin 7 and the resin mold 8, are formed. As a result, the degree of bonding and/or the degree of adhesion between the resin bobbin 7 and the resin mold 8 at the fuel seal portions 67, 68 can be improved.

In this way, the leakage of the fuel from the inside to the outside of the solenoid valve 150 installed in the injector 100 can be reliably limited without using the two seal members, such as the 0-rings, thereby enabling the reduced costs and reduced size of the solenoid valve 150 (and thereby the injector 100).

(Second Embodiment)

FIGS. 9A to 9E show the fuel seal structure of the solenoid valve 150 of the injector 100 of the fuel injection apparatus as well as the surface modification method of the thermoplastic resin bobbin of the solenoid valve 150 according to a second embodiment of the present disclosure.

In the following discussion, the components, which are similar to those of the first embodiment, will be indicated by the same reference numerals and will not be described further for the sake of simplicity.

Figure 9A:
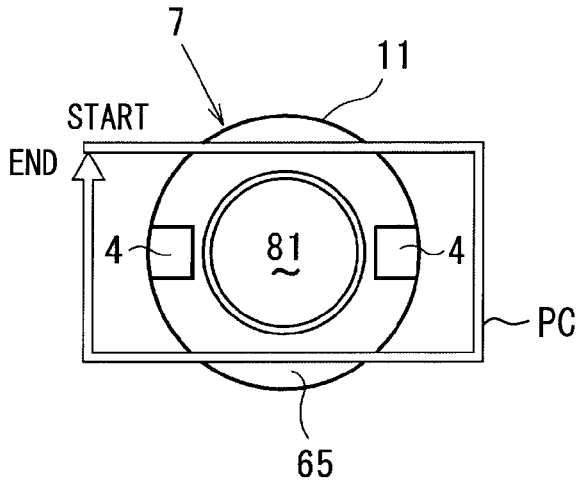
FIG. 9A is a schematic diagram showing a surface modification process (a plasma irradiation process) applied to an upper surface of a resin bobbin according to a second embodiment of the present disclosure.

The plasma nozzle 9 is placed above the resin bobbin 7 (more specifically the upper surface of the flange 11) and is moved horizontally along a rectangular moving path Pc shown in FIG. 9A to irradiate the plasma onto the portion of the upper surface of the flange 11. In this way, the surface-modified portion 71, which is configured into the annular form and is surface-modified with the irradiation of the plasma to have the above function (the oxygen-containing functional group), is formed on the portion (the inner peripheral edge portion) of the upper surface of the flange 11 in the resin bobbin 7.

The moving speed of the plasma nozzle 9 is about 10 to 30 mm per second.

Figure 9B:
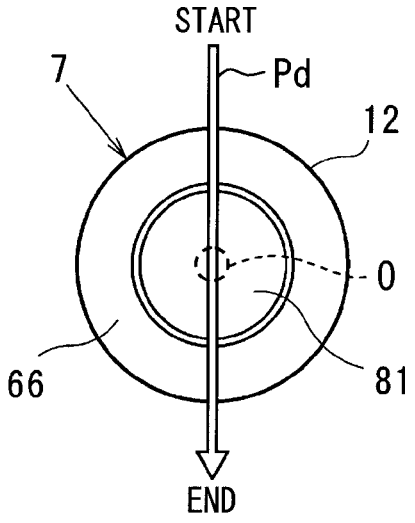
FIG. 9B is a schematic diagram showing the surface modification process (the plasma irradiation process) applied to a lower surface of the resin bobbin according to the second embodiment.
Figure 9D:
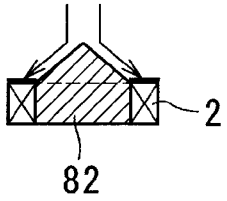
FIG. 9D is a schematic diagram showing another example of a jig used in the process of FIG. 9A or FIG. 9B.
Figure 9C:
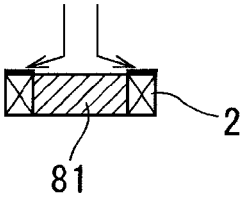
FIG. 9C is a schematic diagram showing an example of a jig used in the process of FIG. 9A or FIG. 9B.
Figure 9E:
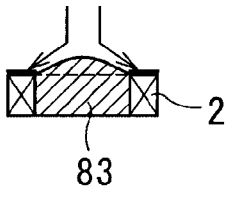
FIG. 9E is a schematic diagram showing another example of a jig used in the process of FIG. 9A or FIG. 9B.

Furthermore, the plasma nozzle 9 is placed above the resin bobbin 7 (more specifically the inverted lower surface of the flange 12) and is moved horizontally along a straight moving path Pd shown in FIG. 9B to irradiate the plasma onto the entire lower surface of the flange 12. In this way, the surface-modified portion 72, which is configured into the annular form and is surface-modified with the irradiation of the plasma to have the above function (the oxygen-containing functional group), is formed on the entire lower surface of the flange 12 in the resin bobbin 7.

The moving speed of the plasma nozzle 9 is about 10 to 30 mm per second.

Furthermore, the movement of the plasma nozzle 9 (the relative movement of the plasma nozzle 9 relative to the resin bobbin 7) may be stopped, i.e., paused for the predetermined time period (e.g., about one to five seconds) from the time of reaching the stop position O shown in FIG. 9B. In this way, the surface-modified portion 72, which is configured into the annular form, can be formed in the lower surface of the flange 12.

According to the surface modification method with the plasma irradiation of the second embodiment, the advantages, which are similar to those of the first embodiment, can be achieved.

(Third Embodiment)

Figure 10A:
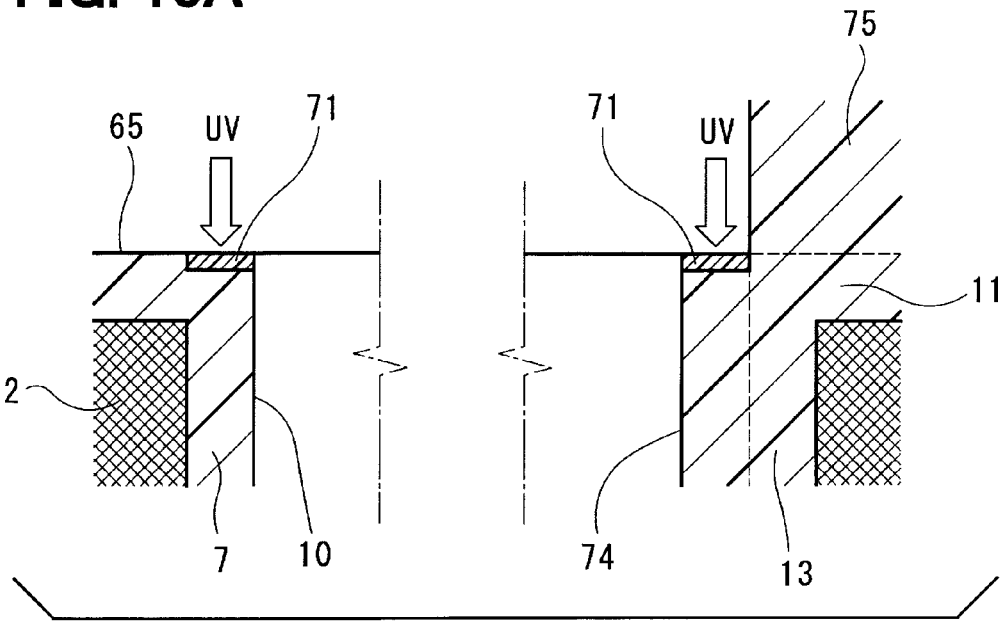
FIG. 10A is a partial enlarged cross-sectional view showing a surface modification process (a UV light irradiation process) applied to an upper surface of a resin bobbin according to a third embodiment of the present disclosure.
Figure 10B:
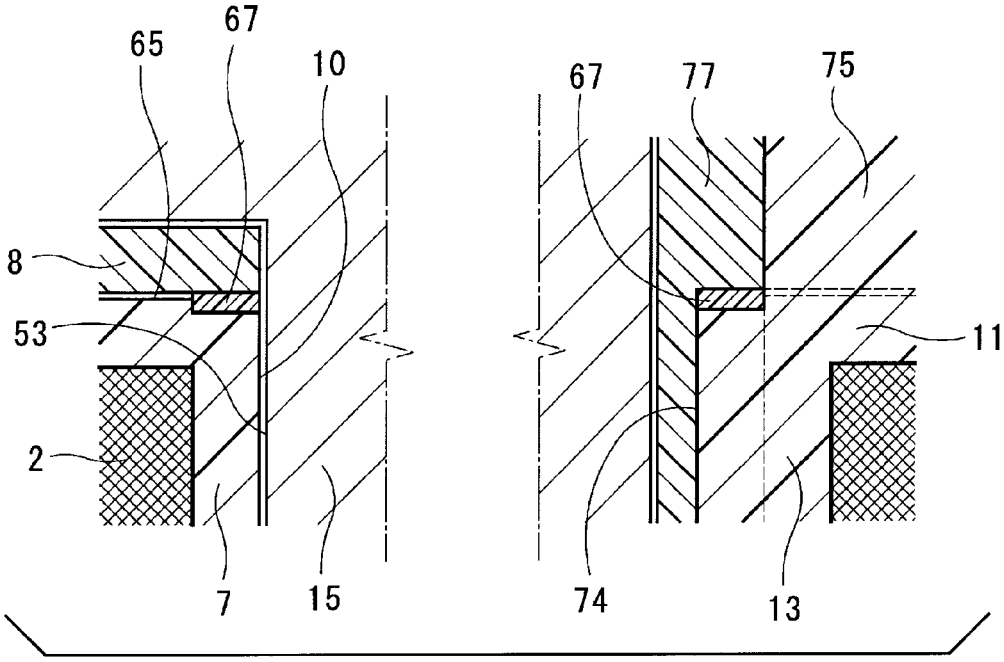
FIG. 10B is a partial enlarged cross-sectional view showing a fuel seal portion formed at a surface between the resin bobbin and the resin mold according to the third embodiment.

FIGS. 10A and 10B show the fuel seal structure of the solenoid valve 150 of the injector 100 of the fuel injection apparatus as well as the surface modification method of the thermoplastic resin bobbin of the solenoid valve 150 according to a third embodiment of the present disclosure.

In the following discussion, the components, which are similar to those of the first and second embodiments, will be indicated by the same reference numerals and will not be described further for the sake of simplicity. Furthermore, the fuel seal portion 68 and the surface-modified portion 72 are not shown for the sake of simplicity.

According to a third embodiment, the surface modification process is carried out with an ultraviolet (UV) light generating apparatus, which irradiate a UV light on the portion of the upper surface of the flange 11 and the entire lower surface of the flange 12 of the resin bobbin 7. In the UV light generating apparatus, the UV light may be generated from a UL lamp or a UV light emitting diode (UV LED).

When the UV light, which is generated from the UV light generating apparatus, is irradiated on the upper surface of the flange 11 and the lower surface of the flange 12, the surface-modified portions 71, 72, each of which is modified to have the above-described function (the oxygen-containing functional group, such as —OH, —COOH), is formed, like in the first and second embodiments. The depth of the surface-modified portions 71, 72 is a predetermined depth (e.g., about 1 nm) from the resin surface.

Furthermore, the solenoid valve 150, particularly the coil assembly has the resin-bonded body 6 that includes the fuel seal portions 67, 68, each of which limits the leakage of the fuel from the corresponding boundary surface 65, 66 between the resin bobbin 7 and the resin mold 8 to the outside, like in the first and second embodiments.

According to the surface modification method with the UV light irradiation of the third embodiment, the advantages, which are similar to those of the first and second embodiments, can be achieved.

(Fourth Embodiment)

Figure 11A:
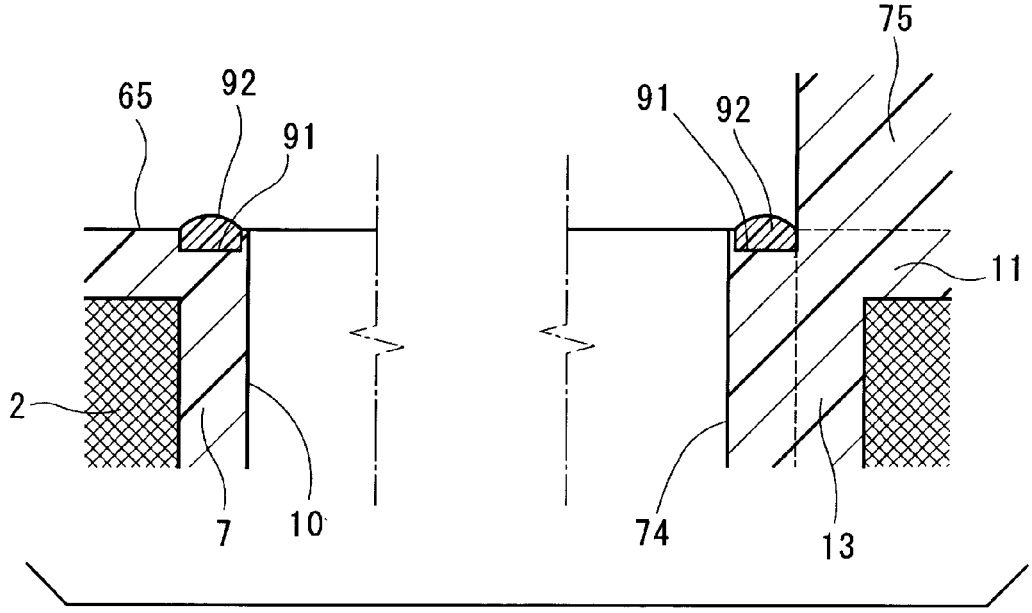
FIG. 11A is a partial enlarged cross-sectional view showing a surface modification process (a primer application process) applied to an upper surface of a resin bobbin according to a fourth embodiment of the present disclosure.
Figure 11B:
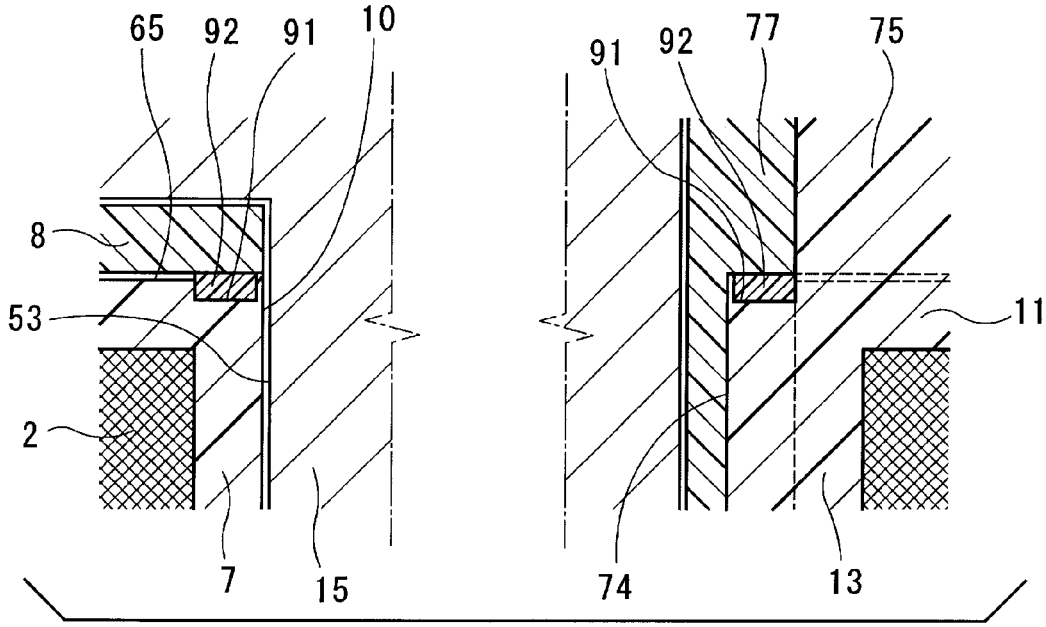
FIG. 11B is a partial enlarged cross-sectional view showing a fuel seal portion (an epoxy bonding agent) formed at a boundary surface between the resin bobbin and the resin mold according to the fourth embodiment.
Figure 12:
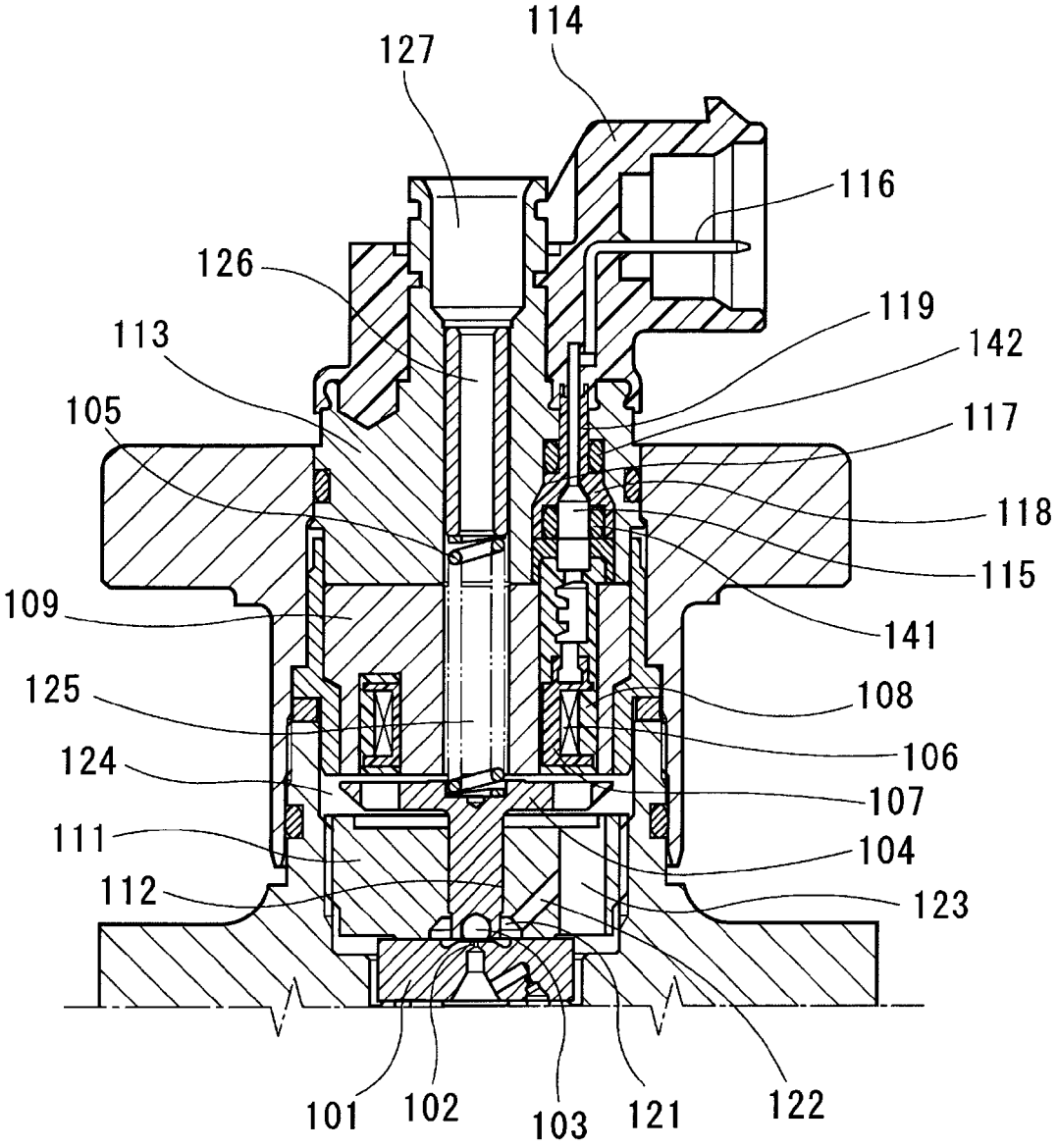
FIG. 12 RELATED ART
FIG. 12 is an enlarged cross-sectional view showing a structure around a solenoid valve of an injector of a related art.
Figure 13:
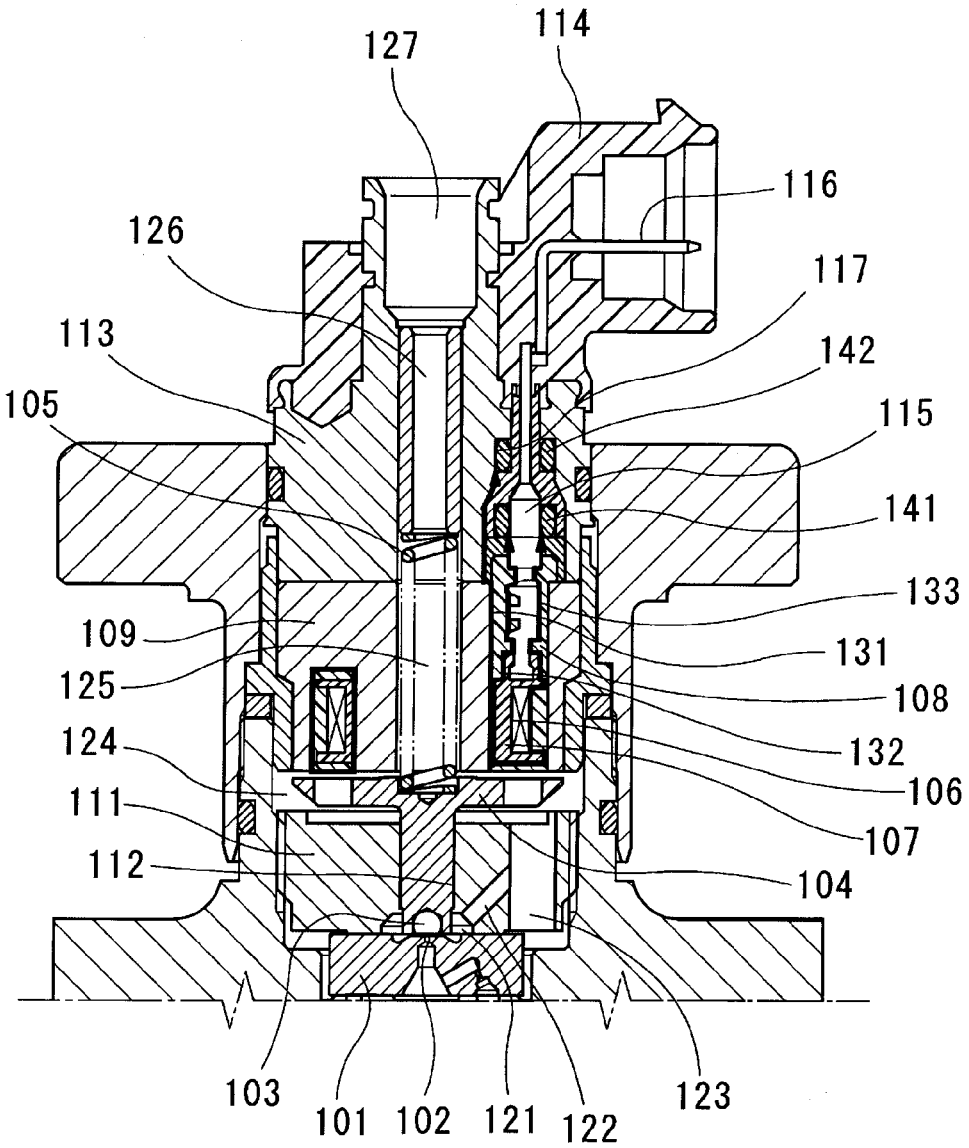
FIG. 13 RELATED ART
FIG. 13 is an enlarged cross-sectional view showing a fuel leak passage from a boundary surface between a resin bobbin and a resin mold of a solenoid actuator to an outside in the related art.

FIGS. 11A and 11B show the fuel seal structure of the solenoid valve 150 of the injector 100 of the fuel injection apparatus as well as the surface modification method of the thermoplastic resin bobbin of the solenoid valve 150 according to a fourth embodiment of the present disclosure.

In the following discussion, the components, which are similar to those of the first to third embodiments, will be indicated by the same reference numerals and will not be described further for the sake of simplicity. Furthermore, the fuel seal portion 68 is not shown for the sake of simplicity.

In the present embodiment, a primer is applied to the upper surface of the flange 11 and the lower surface of the flange 12 of the resin bobbin 7 to form the fuel seal portions 67, 68.

Specifically, an annular groove 91 is formed in the upper surface of the flange and the lower surface of the flange 12. Then, a bonding agent (serving as a primer) 92, which is of an epoxy (EP) type, is applied to the annular groove 91 at each of the upper surface of the flange 11 and the lower surface of the flange 12 in a appropriate amount. At this time, it is desirable that the bonding agent 92 is bulged outward from the upper surface of the flange 11 and the lower surface of the flange 12.

It is desirable that the bonding agent 92 is a silane coupling agent (γ-glycidoxy propyl trimethoxy silane), which can effectively bond with the thermoplastic resin material and the thermoset resin material.

When the coil 2, the terminals 4 and the resin bobbin 7 are resin sealed by the resin mold 8 after the application of the primer (after the execution of the primer application process), the bonding agent 92 remains in the portion of the boundary surface 65, 66 between the resin bobbin 7 and the resin mold 8. Therefore, the degree of bonding and the degree of adhesion between the resin bobbin 7 and the resin mold 8 are improved, i.e., are increased.

Furthermore, as a pre-treatment process, which is performed before the application of the bonding agent 92, the plasma irradiation or the UV light irradiation discussed in any one of the first to third embodiments, may be executed on the upper surface of the flange 11 and the lower surface of the flange 12 of the resin bobbin 7 to improve the degree of bonding and the degree of adhesion between the resin bobbin 7 and the bonding agent 92.

With the primer application process of the present embodiment, the advantages, which are similar to those of the first to third embodiments, may be achieved.

Now, modifications of the above embodiments will be described.

In the above embodiments, the resin-bonded body 6 is provided in the solenoid valve 150 (the solenoid actuator 151, the coil assembly) of the injector 100. Alternatively, the resin-bonded body of the present disclosure may be provided in a solenoid control valve (a solenoid actuator, a coil assembly), which is installed in a fuel injection pump (e.g., a supply pump). Further alternatively, the resin-bonded body of the present disclosure may be provided in a solenoid depressurizing valve (a solenoid actuator, a coil assembly), which is installed in a common rail.

In the above embodiments, the injector, which is applied to the common rail fuel injection apparatus (system), is used as the fuel injection valve, which injects the fuel in the internal combustion engine. Alternatively, the fuel injection valve, which injects the fuel in the internal combustion engine, may be a fuel injection nozzle, which injects fuel into a cylinder of the engine through opening movement of a needle upon increasing of the fuel pressure (the nozzle opening force) of the fuel well above the urging force of the spring (the axial force in the valve-closing direction, i.e., the nozzle closing force) after direct supply of the fuel from a fuel injection pump (e.g., an in-line fuel injection pump or a distributor fuel injection pump) to the fuel well.

In the above embodiments, the injector of the top return type, which discharges the fuel from the top return tube provided at the upper end portion of the solenoid valve at the time of valve opening of the solenoid valve, is used as the injector of the present disclosure. Alternatively, a side return type injector, which discharges fuel from an outlet port of the injector body at the time of valve opening of the solenoid valve, may be used as the injector of the present disclosure.

Furthermore, the fuel injection apparatus of the present disclosure may be applied to a fuel injector of a gasoline engine, which directly injects the fuel into the cylinder of the internal combustion engine.

In the above embodiments, the solenoid actuator 151, which controls the back pressure of the needle and the piston by the magnetic force generated from the coil 2, is used as the actuator, which controls the opening and closing movements of the needle to open and close the fuel injection hole. Alternatively, the actuator of the present disclosure may be a piezoelectric actuator, which controls the opening and closing movements (fuel injection) of the needle through increasing or decreasing of a fuel pressure in a pressure control chamber in response to reciprocation of a pressurizing piston that is driven through expansion or contraction of a piezoelectric stack.

Furthermore, the actuator, which executes the opening and closing movements of the needle in the axial direction, may be implemented by an electric actuator that has an electric motor, a speed reducing mechanism and a converting mechanism.

In the above embodiment, the remote type plasma irradiation process is performed as the surface modification process. Alternatively, a direct type plasma irradiation process may be performed as the surface modification process of the present disclosure.

In the above embodiments, the plasma irradiation process, the UV light irradiation process or the primer application process is executed as the surface modification process. Alternatively, a corona discharge process or a laser irradiation process may be executed as the surface modification process.

Additional advantages and modifications will readily occur to those skilled in the art. The present disclosure in its broader terms is therefore not limited to the specific details, representative apparatus, and illustrative examples shown and described.

What is claimed is:

1. A fuel injection apparatus comprising:

a resin-bonded body that includes a first resin material and a second resin material, which are bonded together and have different properties, respectively; and an injector that injects fuel into a cylinder of an internal combustion engine, wherein the resin-bonded body is provided in the injector, wherein:

the resin-bonded body has a fuel seal portion to limit leakage of fuel from a boundary surface between the first resin material and the second resin material to an outside;

the fuel seal portion is formed in a portion of the boundary surface and is surface-modified to increase hydrophilicity of the fuel seal portion;

the injector includes:

a valve that is configured to open and close a passage hole of the injector, which conducts fuel; and a solenoid that includes a coil, which generates a magnetic force upon energization thereof, wherein the solenoid is configured to drive the valve with the magnetic force generated from the coil in a valve-opening direction of the valve; and the solenoid includes:

a plurality of terminals that are electrically connected to a plurality of coil end leads, respectively, of the coil;

a resin bobbin that is configured into a tubular form, wherein the coil is wound around the resin bobbin; and a resin mold that seals the coil, the plurality of terminals and the resin bobbin, wherein the resin bobbin is made of one of the first resin material and the second resin material, and the resin mold is made of the other one of the first resin material and the second resin material.

2. The fuel injection apparatus according to claim 1, wherein one of the first resin material and the second resin material is a thermoplastic resin material.

3. The fuel injection apparatus according to claim 1, wherein one of the first resin material and the second resin material is a hard-to-bond resin material.

4. The fuel injection apparatus according to claim 2, wherein the other one of the first resin material and the second resin material is a thermoset resin material.

5. The fuel injection apparatus according to claim 1, wherein the fuel seal portion is formed in at least one of a surface of the first resin material and a surface of the second resin material through one of plasma irradiation and ultraviolet light irradiation.

6. The fuel injection apparatus according to claim 5, wherein the fuel seal portion has a surface-modified portion, which increases at least one of a degree of bonding and a degree of adhesion between the first resin material and the second resin material.

7. The fuel injection apparatus according to claim 1, wherein the fuel seal portion is formed through application of a primer to at least one of a surface of the first resin material and a surface of the second resin material.

8. The fuel injection apparatus according to claim 7, wherein the fuel seal portion has a bonding agent as the primer, and the bonding agent bonds or adheres between the first resin material and the second resin material.

* * * * *